US007377283B2

(12) United States Patent
Walker et al.

(10) Patent No.: US 7,377,283 B2
(45) **Date of Patent: *May 27, 2008**

(54) COILED TUBING WELLBORE CLEANOUT

(75) Inventors: Scott A. Walker, Calgary (CA); Jeff Li, Calgary (CA); Graham Wilde, Calgary (CA)

(73) Assignee: BJ Services Company, Houston, TX (US)

( * ) Notice: Subject to any disclaimer, the term of this patent is extended or adjusted under 35 U.S.C. 154(b) by 82 days.

This patent is subject to a terminal disclaimer.

(21) Appl. No.: 11/283,916

(22) Filed: Nov. 21, 2005

(65) Prior Publication Data

US 2006/0102201 A1 May 18, 2006

Related U.S. Application Data

(63) Continuation of application No. 11/120,803, filed on May 2, 2005, now Pat. No. 6,982,008, which is a continuation of application No. 10/429,501, filed on May 5, 2003, now Pat. No. 6,923,871, which is a continuation of application No. 09/799,990, filed on Mar. 6, 2001, now Pat. No. 6,607,607.

(60) Provisional application No. 60/200,241, filed on Apr. 28, 2000.

(51) Int. Cl.
*B08B 9/04* (2006.01)

(52) U.S. Cl. ..... 134/22.1; 134/18; 134/22.18; 134/34; 166/311; 166/312; 175/207; 175/215

(58) Field of Classification Search ..... 134/18, 134/22.1, 22.18, 24, 34
See application file for complete search history.

(56) References Cited

U.S. PATENT DOCUMENTS

| | | | | |
|---|---|---|---|---|
| 3,912,173 | A | 10/1975 | Robichaux | 239/443 |
| 4,187,911 | A | 2/1980 | Hutchison et al. | 166/312 |
| 4,441,557 | A | 4/1984 | Zublin | 166/312 |
| 4,518,041 | A | 5/1985 | Zublin | 166/312 |
| 4,671,359 | A | 6/1987 | Renfro | 166/312 |
| 4,694,901 | A | 9/1987 | Skinner | 166/77 |
| 4,744,420 | A | 5/1988 | Patterson et al. | 166/312 |

(Continued)

FOREIGN PATENT DOCUMENTS

GB 9217186.7 12/1992

(Continued)

OTHER PUBLICATIONS

A.A. Gavignet, et al., SPE 15417 "A Model for the Transport of Cuttings in Highly Deviated Wells"; © 1986.

(Continued)

*Primary Examiner*—Joseph L. Perrin
*Assistant Examiner*—Joy Watson
(74) *Attorney, Agent, or Firm*—Howrey LLP

(57) ABSTRACT

A method and apparatus for substantially cleaning fill from a borehole is described variously including running a coiled tubing assembly into the wellbore, creating a fluid vortex by circulating cleaning fluid through the coiled tubing, and pulling the coiled tubing and coiled tubing assembly out of the hole at a speed sufficient to substantially clean the particulate solids from the wellbore. An apparatus for substantially cleaning fill from a hole, including vertical, horizontal, or deviated wells also is provided.

12 Claims, 17 Drawing Sheets

U.S. PATENT DOCUMENTS

| | | | | |
|---|---|---|---|---|
| 4,909,325 | A | 3/1990 | Hopmann | 166/312 |
| 4,919,204 | A | 4/1990 | Baker et al. | 166/223 |
| 4,967,841 | A | 11/1990 | Murray | 166/312 |
| 5,033,545 | A | 7/1991 | Sudol | 166/312 |
| 5,086,842 | A | 2/1992 | Cholet | 166/312 |
| 5,280,825 | A | 1/1994 | Cholet | 166/311 |
| 5,314,545 | A | 5/1994 | Folts et al. | 134/22.11 |
| 5,392,862 | A | 2/1995 | Swearingen | 166/386 |
| 5,431,227 | A | 7/1995 | Montgomery et al. | 166/307 |
| 5,447,200 | A | 9/1995 | Dedora et al. | 166/311 |
| 5,462,118 | A | 10/1995 | Jennings et al. | 166/312 |
| 5,638,904 | A | 6/1997 | Misselbrook et al. | 166/384 |
| 5,865,249 | A | 2/1999 | Gipson et al. | 166/312 |
| 5,984,011 | A | 11/1999 | Misselbrook et al. | 166/312 |
| 6,029,746 | A | 2/2000 | Dodd | 166/312 |
| 6,062,311 | A | 5/2000 | Johnson et al. | 166/312 |
| 6,065,540 | A | 5/2000 | Thomeer et al. | 166/297 |
| 6,073,696 | A | 6/2000 | Ellis | 166/312 |
| 6,085,844 | A | 7/2000 | Palmer et al. | 166/312 |
| 6,138,757 | A | 10/2000 | Latos et al. | 166/265 |
| 6,161,632 | A | 12/2000 | Hovden | 175/317 |
| 6,170,577 | B1 | 1/2001 | Noles, Jr. et al. | 166/312 |
| 6,250,389 | B1 | 6/2001 | Sudol | 166/312 |
| 6,435,447 | B1 * | 8/2002 | Coats et al. | 242/483 |

FOREIGN PATENT DOCUMENTS

| | | |
|---|---|---|
| GB | 9913998.2 | 12/1999 |
| NO | 302252 B1 | 2/1998 |
| WO | WO99/49181 | 9/1999 |

OTHER PUBLICATIONS

Alain A. Gavignet, et al., "Model Aids Cuttings Transport Prediction"; © 1989 Society of Petroleum Engineers; JPT Sep. 1989, p. 916-921.

Norwegian Search Report dated Oct. 5, 2004 with English translation.

Curtis G. Blount, "*Remote Arctic Locations*;" pp. 110-111; (1993).

Alexander Sas-Jaworsky II, "*Coiled Tubing . . . Operations and Services*", Part 4; pp. 28-33; 1992.

L.J. Leising and I.C. Walton; "*Cutting Transport Problems and Solutions in Coiled Tubing Drilling*"; IADC/SPE 39300; IADC/SPE Drilling Conference Mar. 3, 1998.

Brown, N.P., Bern, P.A., and Weaver, A., "*Cleaning Deviated Holes: New Experimental and Theoretical Studies*," SPE/IADC 18636, IADC/SPE Drilling Conference, New Orleans, Feb. 1989.

Sifferman, T.R. and Becker, T.E., "*Hole Cleaning in Full-Scale Inclined Wellbores*," SPE 20422, Drilling Engineering, Jun. 1992, 115-120.

Larsen, T.I., Pilehvari, A.A. and Azar, J.J., "*Development of a New Cuttings Transport Model for High-Angle Wellbores Including Horizontal Wells*", SPE 25872, SPE Rocky Mountain Regional/Low Permeability Reservoirs Symposium, Denver, Apr. 1993.

Gavignet, A.A. and Sobey, I.J., "*A Model for Cuttings Transport in Highly Deviated Wells*," SPE 15417, SPE Annual Technical Conference and Exhibition, New Orleans, Oct. 1986, as reprinted in JPT 1989.

Clark, R.K. and Bickham, "*A Mechanistic Model for Cuttings Transport*," SPE 28306, SPE ATCE, New Orleans, Sep. 1994.

Santana, M. Martins, A.L. and Sales Jr., A., "*Advances in the Modeling of the Stratified Flow of Drill Cuttings in High Angle and Horizontal Wells*," SPE 39890, Int. Petroleum Conference and Exhibition of Mexico, Mexico, Mar. 1998.

Nguyen, D. and Rahman, S.S., "*A Three-Layer Hydraulic Program for Effective Cuttings Transport and Hole Cleaning in Highly Deviated and Horizontal Wells*," SPE Drilling & Completion, Sep. 1998, 182-189, SPE 51186.

Gary, S.C., Walton, I.C. and Gu, H., "*Two New Design Tools Maximize Safety and Efficiency for Coiled Tubing Pumping Treatments*," SPE 29267, SPE Asia Pacific Oil & Gas Conference, Kuala Lumpur, Malaysia, Mar. 1995.

Walton, I.C., "*Computer Simulator of Coiled Tubing Wellbore Cleanouts in Deviated Wells Recommends Optimum Pumprate and Fluid Viscosity*," SPE 29491, Schlumberger Dowell, 1995.

Walker, S. and Li, J, BJ Services Company, "*Coiled-Tubing Wiper Trip Hole Cleaning in Highly Deviated Wellbores*," SPE 68435, SPE/IcoTA Coiled Tubing Conference and Exhibition, Houston, Mar. 2001.

Li, J. Walker, S. and Aitken, B., BJ Services Company, "*How to Efficiently Remove Sand From Deviated Wellbores With a Solids Transport Simulator and a Coiled Tubing Cleanout Tool*," SPE 77527, SPE Annual Technical Conference and Exhibition, San Antonio, Sep. 29-Oct. 2, 2002.

Luo, Y., Bern, P.A. and Chamber, B.D., "*Flow Rate Predictions for Cleaning Deviated Wells*," IADC/SPE 23884, IADC/SPE Drilling Conference, New Orleans, Feb. 1992.

Gu, H. and Walton, I.C., "Development of a Computer Wellbore Simulator for Coiled-Tubing Operations," SPE 28222, SPE Petroleum Computer Conference, Dallas, Jul. 1994.

BJ Services Company, "*Fill Removal*", Chapter 4; Jan. 5, 2002.

Ian C. Walton/Hongren Gu, "*Hydraulics Design in Coiled Tubing Drilling*", SPE 36349 (1995).

J. Li/S. Walker, "*Sensitivity Analysis of Hole Cleaning Parameters in Directional Wells*,", SPE 54498 (1999).

S. Walker/J. Li, "*The Effects of Particle Size, Fluid Rheology, and Pipe Eccentricity on Cuttings Transport*", SPE 60755 (2000).

Canadian Intellectual Property Office examination/search report dated May 24, 2007.

* cited by examiner

| FLUID | ADVANTAGES | DISADVANTAGES | TYPICAL APPLICATIONS |
|---|---|---|---|
| WATER/ BRINE | LOW COST, NO SPECIAL EQUIPMENT REQUIRED, NO CHEMICALS, EASY TO SEPARATE SOLIDS, NO TEMPERATURE LIMITS, SIMPLE DISPOSAL, SAFE | HIGH PARTICLE SETTLING RATE SENSITIVE TO INTERRUPTIONS IN PUMPING (SAND BRIDGES CAN FORM WHEN CIRCULATION STOPS) | UNDERBALANCED CLEANOUT OF LONG DEVIATED AND HORIZONTAL WELLS<br>USED WITH NITROGEN TO ACHIEVE HIGHEST VELOCITIES AND HIGHEST TURBULENCE |
| DIESEL/ BASE OIL | LOWER DENSITY<br>REDUCED DRAG BETWEEN THE COIL AND WELLBORE | HIGHER COST THAN WATER<br>HIGHER VISCOSITY<br>CONTAMINATED SOLIDS LEAD TO HIGHER DISPOSAL COSTS<br>POTENTIAL FOR OIL TO WET PARTICLES LEADING TO CLUMPING | UNDERBALANCED CLEANOUT OF MODERATELY UNDER-PRESSURIZED RESERVOIRS WITHOUT THE USE OF NITROGEN<br>CLEANOUT OF TORTUOUS OR HIGH DRAG COMPLETIONS |
| FRICTION-REDUCED FLUIDS | EASIER TO MIX AND LOWER COST THAN GELS<br>SHORTER JOB TIME THAN WITH WATER<br>MAY PERMIT THE USE OF SMALLER COIL<br>SIMPLE SOLIDS SEPARATION | EXCESSIVE FLUID LOSS MIGHT BE DAMAGING TO THE FORMATION | UNDERBALANCED CLEANOUT |

TO FIG.9B

FIG.9A
(Prior Art)

FROM FIG.9A

| | | | |
|---|---|---|---|
| GELS | TAILORED SUSPENSION CAPABILITIES<br>CAN PROVIDE SOME FRICTION REDUCTION AT LOW/MODERATE LOADINGS | DEGRADE AT HIGH TEMPERATURES<br>HIGH PERFORMANCE GELS CAN BE EXPENSIVE<br>CHEMICAL OR MECHANICAL METHODS OF SOLIDS SEPARATION OFTEN REQUIRED | REMOVAL OF LARGE OR HEAVY FILL FROM VERTICAL WELLS<br>CLEANING SHORT, LARGE DIAMETER DEVIATED SECTIONS<br>OVERBALANCED CLEANOUTS USING THE GEL TO BLOCK THE FORMATION |
| FOAMS | LOW LEAK-OFF TO THE FORMATION<br>MINIMIZE EROSION PROBLEMS IN THE COMPLETION, WELLHEAD AND FLOW LINES | FOAM BREAKERS REQUIRED, COMPLICATING SURFACE<br>MUST CIRCULATE WELL FLUID BEFORE ENTERING FILL | VERY LOW BHP AND LARGE CASING SIZES<br>VERTICAL WELLS WITH VERY LOW CIRCULATION RATES |

FIG.9B
(Prior Art)

| |
|---|
| FIG.9A |
| FIG.9B |

FIG.9
(Prior Art)

COILED TUBING WELLBORE CLEANOUT

CROSS-REFERENCE TO RELATED APPLICATIONS

This application is a continuation application of U.S patent application Ser. No. 11/120,803, entitled "Coiled Tubing Wellbore Cleanout," filed May 2, 2005, now U.S. Pat. No. 6,982,008, issued Jan. 3, 2006, incorporated by reference herein, which is a continuation application of copending U.S. patent application Ser. No. 10/429,501, entitled "Coiled Tubing Wellbore Cleanout," filed May 5, 2003, by Walker, et al., now U.S. Pat. No. 6,923,871, issued Aug. 2, 2005, incorporated by reference herein, which was a continuation of U.S. patent application Ser. No. 09/799,990, filed Mar. 6, 2001, entitled "Coiled Tubing Wellbore Cleanout" Scott A. Walker, Jeff Li and Graham Wilde, now U.S. Pat. No. 6,607,607, issued Aug. 19, 2003, incorporated by reference herein, which claimed priority based on provisional application Ser. No. 60/200,241 filed Apr. 28, 2000, incorporated by reference in their entireties herein.

FIELD OF THE INVENTION

This invention is related to cleaning a wellbore of fill, and more particularly, to cleaning an oil/gas wellbore of substantial fill using coiled tubing.

BACKGROUND OF THE INVENTION

Solutions exist to an analogous problem in a related field, the problem of cuttings beds in the field of coiled tubing drilling in deviated wells, a field employing different equipment in different circumstances. The solutions are similar but have important distinctions with regard to the instant invention. Some, though not all, practitioners when drilling with coiled tubing (CT) in deviated wells cleanout cutting beds that develop by a wiper trip. Cuttings in a deviated well periodically form beds under CT, uphole of the drilling, notwithstanding the efforts to circulate out all of the cuttings with the drilling fluid. Some practitioners periodically disturb and entrain and circulate out their cuttings beds by dragging the bit and its assembly back uphole, while circulating. This bit wiper trip is a relatively short trip through a portion of the borehole and is interspersed, of course, with periods of drilling where more cuttings are created and are (largely) transported out by the circulation of the drilling fluid. The need for a wiper trip is determined by gauging when a cuttings bed is causing too much drag or friction on the coiled tubing such that it is difficult to lay weight on the bit.

The bit wiper trip typically does not comprise a full pulling out of the hole ("POOH") but rather for only 100 feet or so, progressively increasing as more hole is drilled. The trip length may increase as the hole gets deeper. POOH rates with the bit wiper trip are not known to be scientifically selected using computer modeling. This is not a workover situation that targets substantial cleaning of fill in one wiper trip. A bit and its assembly comprise a costly and elaborate downhole tool for a wiper trip.

Key distinctions between the instant invention and periodic bit wiper trips include, firstly, the use herein of a far less expensive jetting nozzle as compared to an expensive drilling bit, motor and associated assemblies, to disturb and entrain the fill. A second distinction is the use of rearward facing jets while POOH by the instant invention. A third key distinction is the engineered selection of pump rates and/or RIH rates and/or POOH rates, based on computer modeling, in order to target a cleanout of the hole in one trip.

In regard to the computer modeling of wells, in general, and further in regard to the modeling of cleanouts per se, it has been known in the art to model a solids/cuttings bed cleanout by modeling circulation in a deviated hole containing coiled tubing. To the inventors' best knowledge, however, it has not been known to model two phase flow in these circumstances nor to model the effects of a dynamic wiper trip while jetting. In particular it has not been known to model a wiper trip involving POOH with a nozzle having uphole pointing jets.

Turning to the well cleanout industry in particular, one problem that has historically faced well owners and operators is the question of whether a well is clean in fact when, during a cleanout, the well is flowing clean with the workover coiled tubing (CT) at target depth (TD). A second problem is that since many of the so-called "routine" cleanouts are not as simple as might be expected, the usual definition of "clean" is likely to be set by local field experience and may not represent what can or should be achieved. A third problem has been determining the question of how clean is clean enough. An ineffective or incomplete well cleanout results in shorter production intervals between cleanouts and increased maintenance.

It costs more to re-do a job than to do it right the first time. The object of the instant invention is to ensure that owners/operators do not incur the costs of recleaning their wells for as long as possible, prolonging well production and maintaining wireline accessibility. A well that requires a cleanout every 12 months between poorly designed, incomplete jobs may last 24 months between properly designed cleanout jobs.

Unless a well is a vertical hole (<35° deviation) with a generously sized completion assembly and moderate bottom hole pressure, cleanout procedures according to conventional practices are likely to leave significant debris or fill in the hole. One further object of the instant invention is to offer a comprehensive engineered approach to CT cleanouts, targeted to substantially clean a hole of fill in one trip.

SUMMARY OF THE INVENTION

In one preferred embodiment the invention includes a method for cleaning fill from a borehole comprising disturbing particulate solids by running in hole, in typical cases through substantial fill, with a coiled tubing assembly while circulating at least one cleanout fluid through a nozzle having a jetting action directed downhole. This invention may include creating particulate entrainment by pulling out of hole while circulating at least one cleanout fluid through a nozzle having a jetting action directed uphole. The invention may include controlling at least one of 1) the pump rate of the cleanout fluid and/or 2) the coiled tubing assembly pullout rate such that substantially all particulate solids are maintained uphole of an end of the coiled tubing assembly during pullout. The invention may also include controlling the POOH rate so that equilibrium sand beds are established uphole of the jets, if or to the extent that such beds were not established during running in hole (RIH).

The invention can include in one embodiment a method for cleaning fill from a borehole in the wiper trip comprising jetting downhole, through a nozzle connected to coiled tubing, at least one cleanout fluid during at least a portion of running downhole. The invention can include jetting uphole through a nozzle connected to the coiled tubing at least one cleanout fluid during at least a portion of pulling out of hole.

The invention can include pumping during at least a portion of pulling out of hole at least one cleanout fluid at a selected pump rate regime, pulling out of hole for at least a section of the borehole at a selected pulling rate regime, and substantially cleaning the borehole of fill. Preferably the invention includes high energy jetting downhole and low engery jetting uphole.

The invention can include a method for cleaning a borehole of fill comprising sweeping back at least one uphole directed jet connected to coiled tubing while pulling out of hole at a selected pulling rate regime. This invention can include pumping at least one cleanout fluid at a selected pump rate regime down the coiled tubing and out the at least one jet during at least a portion of pulling out of hole. The invention can also include selecting, by computer modeling, at least one of 1) pump rate regime and/or 2) pull out of hole rate regime such that one sweep substantially cleans the borehole of fill.

The invention can include a method for cleaning out a borehole of particulate matter comprising modeling a cleanout, taking into account a plurality of well parameters and a plurality of equipment parameters, to produce at least one running parameter regime predicted to clean to a given degree the borehole with one wiper trip of coiled tubing, the coiled tubing attached to at least one forward jet and one reverse jet. This invention can include cleaning the borehole to obtain the given degree of cleanout in on wiper trip with the coiled tubing while implementing at least one produced running parameter regime.

The invention can include apparatus for cleaning fill from a borehole in one wiper trip comprising a nozzle adapted to be attached to coiled tubing, the nozzle having at least one high-energy jet directed downhole, at least one low energy jet directed uphole and means for switching in the nozzle fluid flow from the at least one high energy jet to the at least one low energy jet.

The invention can include a method for cleaning fill from a borehole in one wiper trip comprising computer modeling of solids bed transport in a deviated borehole while pulling out of hole with coiled tubing according to pulling out rate regime and while jetting uphole at least one cleanout fluid according to a cleanout fluid pump rate regime.

In preferred embodiments the invention includes tool design and methodology for coiled tubing in vertical, deviated, and horizontal wells. The invention includes running coiled tubing into the well while circulating water, gelled liquids or multi phase fluids using a nozzle with a "high energy" jetting action pointing forwards down the well to stir up the particulate solids and allow the coiled tubing to reach a target depth or bottom of the well. When the bottom or desired depth is reached, the invention includes reversing the jetting direction of the nozzle to point upward (up the well bore) while circulating water, gelled liquids or multiphase fluids using a low energy vortex nozzle that will create a particle re-entrainment action to enhance agitation of the solids and then entrain the solids in suspension for transport out of the wellbore while pulling the coiled tubing out of the hole. The reverse jetting action along with a controlled pump rate and wiper trip speed can produce a solids transport action which cleans the hole completely by keeping the cuttings in front (upward) of the end of the coiled tubing in continuous agitation. The low energy nozzles have a low pressure drop which allows for higher flow rates which results in improved cleanout efficiency. This method and tool is more efficient than existing methods since the process may be limited to one pass or sweep with the option of resetting the tool for repeated cycles if problems are encountered.

BRIEF DESCRIPTION OF THE DRAWINGS

A better understanding of the present invention can be obtained when the following detailed description of the preferred embodiments are considered in conjunctions with the following drawings, in which:

FIG. 9 illustrates advantages, disadvantages and applications for typical cleanout fluids.

DETAILED DESCRIPTION OF PREFERRED EMBODIMENTS

Figure 1:
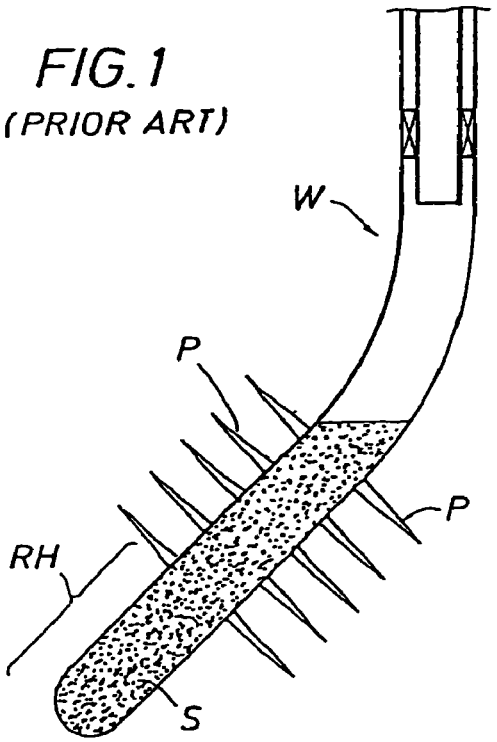
FIG. 1 (PRIOR ART)
FIGS. 1, 2 and 3 illustrate a technique of the prior art that might unsuccesfully cleanout borehole of substantial fill.

The phrase "well parameters" as used herein can include borehole parameters, fill parameters and production parameters. Borehole parameters could include well geometry and completion geometry. Fill parameters might include particle size, particle shape, particle density, particle compactness and particle volume. Production parameters might include whether a borehole is in an overbalanced, balanced or underbalanced condition, whether the borehole is being produced or is shut in or is an injection well, the bottomhole pressure (BHP) and/or the bottomhole temperature (BHT). Equipment parameters could include the type of nozzle(s), the energy and direction of nozzle jet(s), the diameter and type of the coiled tubing and the choice of a cleanout fluid or fluids. Cleanout fluids are typically water, brine, gels, polymers, oils, foams and gases, including mixtures of the above. Two phase flow indicates flow that includes a significant amount of liquid and gas.

A running parameter combination includes at least one of a pump rate regime, fixed or variable, for cleanout fluid(s) and a POOH rate regime, fixed or variable. A pump rate regime possibly extends to include a regime for several cleanout fluids, if a plurality of fluids are used, simultaneously or sequentially, and to include an amount of nitrogen or gas, if any used, and its timing. A sweep rate regime for coiled tubing includes at least a pullout of hole (POOH) rate. Such rates could be variable or fixed and do not necessarily rule out stops or discontinuities or interruptions. A "running parameter regime" is a combination of running parameters, including at least one of a fluid pump rate and a POOH rate, either of which may be fixed or variable.

A wiper trip for coiled tubing indicates one movement of the tubing into the borehole (RIH) and one sweeping back, or pulling out, of the tubing from the borehole (POOH) (or at least a significant segment of the borehole). One wiper trip is traditionally used in the industry to refer to one RIH and one POOH. Typically, the running in hole and pulling out of hole is a complete run, from the surface to the end of the well and back. Effectively, it should be appreciated, a "wiper trip" need only be through a significant portion of the wellbore containing the fill. POOH refers to pulling out of hole. The hole referred to is at least a significant segment of the borehole, if not the full borehole. Typically POOH refers to pulling out of the borehole from the end to the surface. On some occasions the relevant portion of the borehole does not include portions running all the way to the end.

Substantially cleaning a borehole means removing at least 80% of the fill or particulate matter from the borehole. Substantial fill indicates fill of such magnitude, given well parameters, that a portion of the well is substantially occluded by particulate matter. The word fill is used to include various types of fill that accumulate in the bottom or bottom portions of oil and gas boreholes. Typically, fill comprises sand. The two words are sometimes used interchangeably. Fill might include proppant, weighting materials, gun debris, accumulated powder or crushed sandstone. Fill might include general formation debris and well rock.

An uphole directed jet directs fluid uphole. A forward or downhole directed jet directs fluid downhole. Pointing downhole indicates that the exiting fluid is directed, or at least has a significant component of motion directed, in the downhole direction. Pointing uphole indicates that the exiting fluid is directed, or at least has a significant component of motion directed, in the uphole direction. A coiled tubing assembly refers to the coiled tubing and nozzle(s) and/or other equipment attached to the coil downhole. A "high energy jetting action" means a nozzle jet with a substantial pressure drop, in the order of at least 1000 psi, across the nozzle orifice. A low energy jetting action means a nozzle jet with a small pressure drop, in the order of 200 psi or less, across the nozzle orifice. The values for "substantial pressure drop" required to define "high energy jetting" as distinct from "low energy jetting" are a kinetic energy consideration. The most preferred values are 1000 psi and above for high energy and 50 psi and below for low energy. These figures imply at least 200-400 ft/sec velocities for 1000 psi depending on the efficiency of the nozzle, and less than 100 ft/sec for the low energy regime. If it is assumed that the pump rate stays essentially the same, then a high energy jetting action jet will have a small orifice, relatively speaking, while a low energy jetting action jet will have a larger orifice, relatively speaking.

When methods for cleaning substantial fill from a borehole in one wiper trip are discussed, it should be understood that such methods are capable, in at least the large majority of cases, of substantially cleaning fill from a borehole in one wiper trip. One wiper trip represents the ideal job, the "cusp" of an efficiency curve by design. In practice, one wiper trip is not a necessity. For instance, a "shuffle" (RIH/Partial POOH/RIH/full POOH) might be practiced. The partial POOH might only be a few feet.

Disturbing particulate solids of fill indicates disturbing to an extent of significantly redistributing the fill. This is more than a trivial or minor or superficial disruption. Disturbing can also breakup or blow apart conglomerations of particles.

To illustrate preferred embodiments, assume 1,000 feet of casing having the lower 300 feet filled with water and sand. Assume this 1,000 feet of casing is in a well at a 45° inclination. Fill is usually sand or sandstone rock, crushed. It may typically include produced powder or proppant. According to preferred embodiments of the invention, coiled tubing with a selected dual nozzle will run down to and through the upper 700 feet of casing while circulating a pre-selected cleanout fluid. Upon entering the fill a cleanout fluid pump rate will be selected, preferably from a pre-modeling of the well and equipment parameters, such that one or more power jets of the dual nozzle, preferably high energy jets directed downhole, disturb and redistribute the fill and circulate some fill out. A running in hole speed will be selected, preferably in conjunction with computer modeling, such that the run-in speed combined with the selection of cleanout fluid or fluids, pump rate and the power jetting disturbs and redistributes substantially all of the fill such that the casing is no longer completely filled with the fill. Running in hole while disturbing and redistributing fill in a deviated well in most cases will create equilibrium beds of fill out of the 100% packed fill. While 100% packed fill completely filled the interior of the bottom 300 feet of the casing originally, the resulting (likely equilibrium) beds of fill after RIH do not completely fill the interior of the casing.

Upon reaching a target depth, the coiled tubing and nozzle will be pulled out of the hole. Preferably now the direction of the jetting nozzle will be switched to a low energy uphole directed jet or jets. The controlled speed of pulling out of the hole, preferably determined by pre-modeling, is selected in conjunction with cleanout fluid, type of fill, location/depth of fill, pump rate and other well parameters and equipment parameters to wash the fill bed out of the hole. Equilibrium beds, if or to the extent not previously established, should form uphole of the cleanout jet during pullout.

Pumps associated with pumping fluid in coiled tubing have a maximum practical surface operating pressure. Taking the practical operating pressures associated with running coiled tubing into account, the instant invention preferably uses a high-pressure drop nozzle directing cleanout fluid jets downhole during running in hole. Preferably while pulling out of hole the instant invention utilizes a low-pressure drop nozzle with a jet or jets directed uphole.

In general, the faster the pump rate of the cleanout fluid and the faster the POOH rate the faster the total trip and the less the total cost. There are limits to the rates, however, in order to substantially clean in one trip.

One aspect of the instant invention is disturbing particulate solids while RIH with a coiled tubing assembly circulating at least one cleanout fluid through a nozzle having a jetting action directed downhole. The method includes creating particulate entrainment when pulling out of hole while circulating at least one cleanout fluid through a nozzle having a jetting action directed uphole. Further, the invention includes pulling out of hole at such a rate that substantially all solids of the fill are maintained uphole at the end of the coiled tubing assembly during pulling out of hole. It can be seen that if the coiled tubing assembly effectively maintains substantially all of the particulate solids uphole at the end of the assembly, then when the assembly has been pulled out of the hole, substantially all of the particulate solids will have been removed from the hole.

Given well parameters and equipment parameters and a pump rate, selected through engineering in order to enable a cleanout in one wiper trip, effecting a cost effective and substantially complete cleanout in one wiper trip requires careful attention to the rate of pulling out of hole. It is important to pullout of hole as quickly as possible as long as all particulate solids are maintained uphole of an end of the coiled tubing assembly, for cost effectiveness reasons. However, in order to affect the cleanout in one wiper trip, the pulling out of hole rate must pay attention to the establishment of equilibrium beds uphole of the end of the coiled tubing. An equilibrium bed is a fill bed of such cross sectional dimension that the remaining annulus in the casing (or hole or pipe) for circulating a cleanout fluid and entrained particulates is sufficiently small that the velocity through that reduced annulus portion is sufficiently high that the entrained transport particulates can not settle out, but are transported uphole.

In most cleanouts, equilibrium beds would be formed behind the coiled tubing as the coiled tubing and nozzle are run into the hole. That is, the downhole directed jet of the nozzle will disturb the exiting fill. This disturbing will redistribute the fill while at the same time circulate some fill back out of the hole. In many situations, much of the redistributed fill will form "equilibrium beds" behind the end of the coiled tubing nozzle while running in hole. By definition of equilibrium beds, the velocity of the cleanout fluid and entrained sand through the remaining part of the annulus is sufficiently high that no further fill particulates can settle out. Since an equilibrium bed, by definition, cannot grow, the remaining sand particulates or fill will be transported out of the hole.

Pulling out of hole picks up the leading or downhole edge of the equilibrium bed, disturbs and entrains the leading edge, and sends the fill up the hole past the equilibrium beds to the surface. Since the uphole bed has reached equilibrium state, the entrained sand particulates at the leading or downhole end of the equilibrium beds must be transported to the surface. The rate of pulling out of hole should not exceed a rate such that the above conditions cannot be maintained.

Figures 21A, 21B:
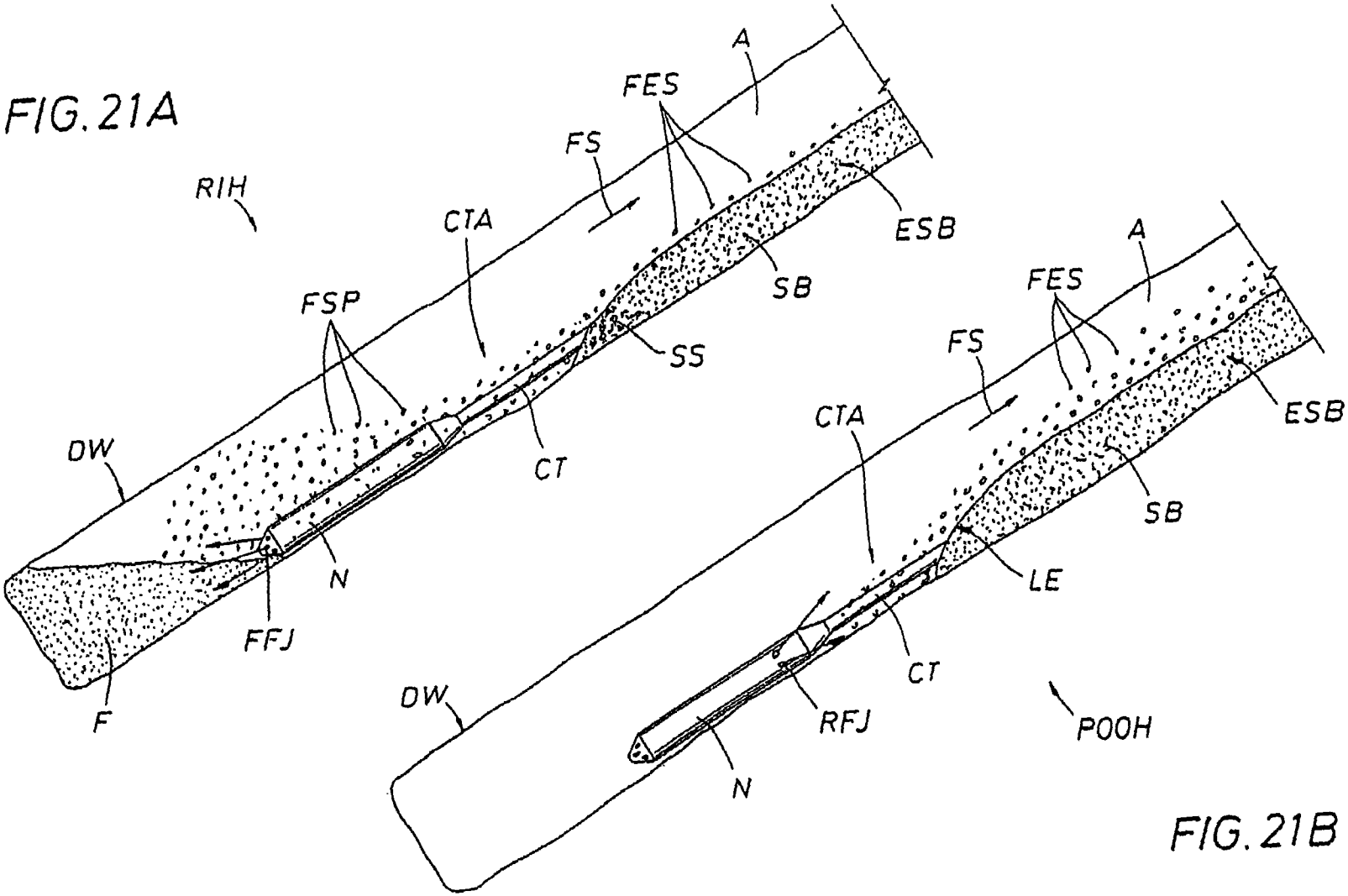
FIGS. 21A and 21B illustrate methodologies associated with the instant invention.

FIGS. 21A and 21B illustrate the above principles. FIG. 21A illustrates coiled tubing CT. FIG. 21A illustrates an inclined wellbore DW filled at its bottom with original sand F. Coiled tubing CT carrying coiled tubing assembly CTA is run in the hole defined by inclined wellbore DW. Coiled tubing assembly CTA includes a nozzle N, such as with forward facing jets FFJ. Forward facing jets have a jetting action directed downhole. Preferably forward facing jets have a high-pressure drop or high energy jetting action while running in hole. Nozzle N with jets FFJ create fluid sand particulates FSP out of the original sand or fill F. The fluid sand particulates move in fluid stream FS uphole toward the surface. Some sand particulates SS settle under gravity until they form equilibrium sand beds SB in the remaining annulus area A until the annulus area for the fluid stream FS becomes sufficiently small by virtue of equilibrium sand beds ESB that no further sand particulates can settle. That is, the velocity of the fluid stream FS becomes so great in the annulus that sand particulates no longer settle. Equilibrium sand beds do not grow. During pulling out of hole or POOH, the cleanout fluid is jetted through rearward facing jets RFJ. Preferably rearward facing jets are low pressure drop or low energy jets. Rearward facing jets pick up the leading edge LE of the equilibrium sand beds laid behind during running in the hole. This fluidized sand comprises fluidized excess sand FES and moves in fluid stream FS uphole to the surface. Equilibrium sand beds ESB are of such size that no further sand can be deposited because the velocity of the fluid stream with the entrained fluidized as sand is too great. The rate of pulling out of the hole should be sufficiently slow such than the forward facing jets can completely erode the leading edge of the equilibrium sand beds as they move.

Using coiled tubing modeling and job planning software, it is possible to take virtually every operational variable into account. Cleanouts in accordance with the instant invention can be designed to:

Maximize debris removal

Minimize nitrogen consumption

Reduce overall cost of cleanouts

Fluid selection and running procedures can be determined in accordance with the instant invention according to completion geometries and the type and volume of fill to be removed. Fluid selecting can be critical. Low-cost fluids often cannot suspend fill particles efficiently under downhole conditions because these polymers will typically thin under high temperature and shear forces. Conversely, advanced fluids can be uneconomical to use, and even unnecessary if running procedures such as varying the pump rate can lift the fill. The instant invention focuses on the most effective and economical approach, minimizing costs.

If an owner/operator has a deviated well, compacted fill, a slim-hole completion, elevated bottom hole temperature (BHT) or any of dozens of other complicating factors, the engineered approach to CT cleanouts of the instant invention can produce the most cost-effective results.

Figure 2:
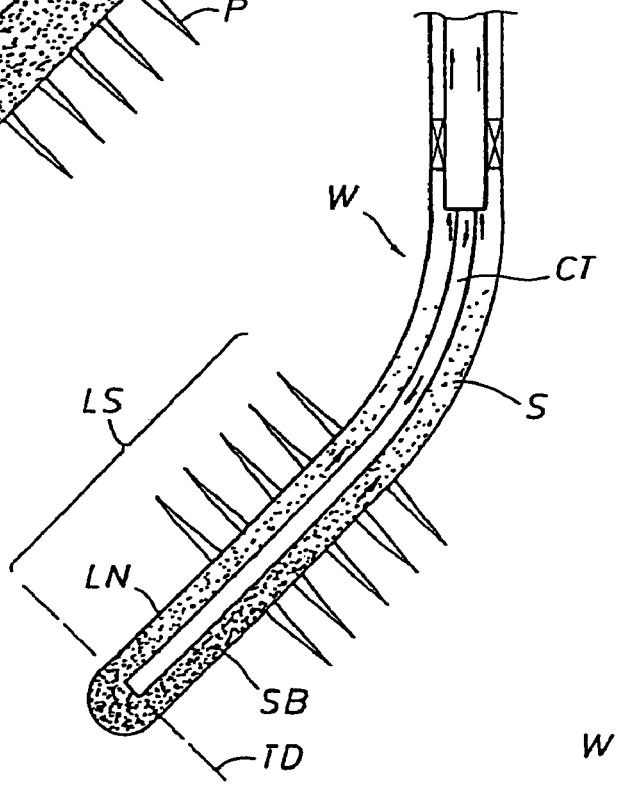
FIG. 2 (PRIOR ART)
Figure 3:
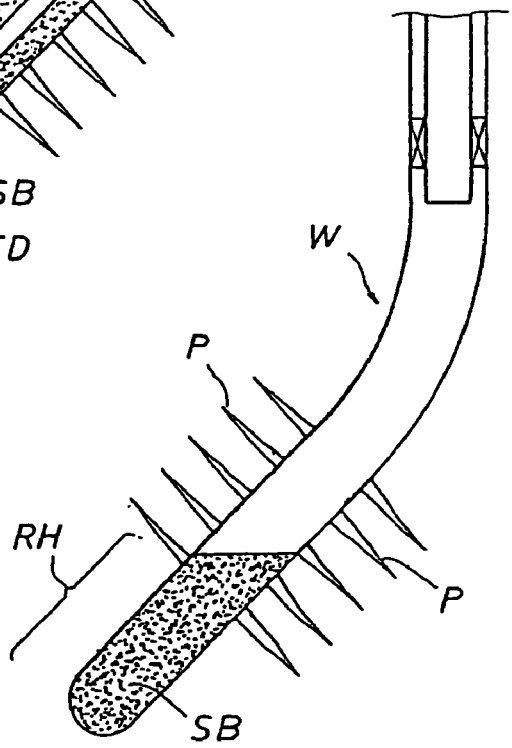
FIG. 3 (PRIOR ART)

A well may not be clean just because it is flowing and the CT has reached target depth (TD). Fill can be fluidized by the CT, yet not lifted to the surface, but instead falling back down into the rat hole when circulation stops. FIGS. 1-3 illustrate the problems that can occur with conventional CT cleanouts. FIG. 1 illustrates a 35° deviated well W sanded up S to block or partially cover the perforations P. Wells that produce sand S will usually fill the rat hole RH slowly over time. When the sand S starts to cover the perforations P, well performance will be degraded.

FIG. 2 illustrates the same well W with coiled tubing CT run to TD and sand S fluidized above a stationary bed SB on the low side. If the critical velocity is not achieved, much of the sand S forms a sand bed SB on the low side LS of the liner LN and is never produced to surface. The well appears clean because the returns are clean and the coil is stationary at TD.

FIG. 3 illustrates the coiled tubing CT now removed and where the sand bed SB has fallen down to the bottom and is occupying the rat hole RH. Continuing and production will fill the remaining rat hole sooner than if it had been fully cleaned. Cleaning the entire rat hole means less frequent cleanouts and more consistent wireline accessibility.

Figure 4:
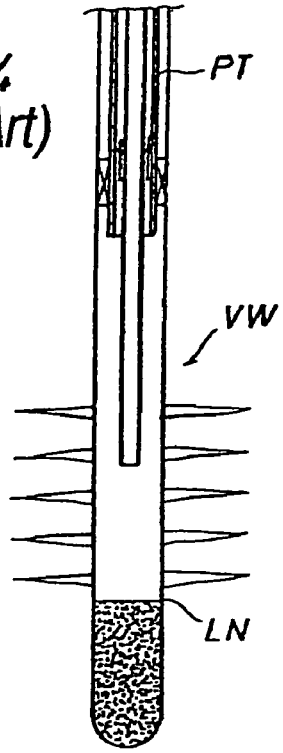
FIG. 4 (Prior Art)
FIG. 4 illustrates a vertical well with substantial fill.

Cleaning a vertical well VW, FIG. 4, is often viewed as simple, yet there are many ways the cleanout can be made faster and more efficient. A common factor limiting the rate at which a well can be cleaned is "annular choking" in the production tubing PT. A conventional well has production tubing PT that is much smaller than the production casing or liner LN. Achieving enough velocity in the liner to lift the fill in a reasonable period of time can result in very high velocities in the production tubing. The high velocities result in large friction pressures that can overburden the well, causing potentially damaging lost returns to the formation.

This effect can be countered by using coiled tubing that is not too large, to provide for an adequate annular space, and by choosing a fluid that has efficient lift properties in the liner yet low friction pressure in the production tubing. Friction reducers in water (005-0.1% loading) typically offer the best fluid selection when cleaning fine particles (e.g., formation sand) from wells in the balanced or underbalanced state. These products reduce the friction pressure in the coil, either permitting faster circulation rates or the use of smaller coil. Smaller coil can mean cheaper operations, can solve offshore weight restriction problems, and also reduce annular chocking. Friction reducers also reduce the friction in the annulus, therefore, reducing the chocking effect. Cleanout rates can generally be increased by up to 50% using friction reducers as they typically permit higher fill penetration rates and quicker "bottoms-up" times. Finally, friction reducers slightly reduce the particle settling rate, aiding transportation in the well but at the same time keep surface separation simple, not preventing sand from settling in surface tanks. The engineered approach of the instant invention can evaluate these complex factors and, by computer modeling, suggest the cost effective solution.

Large particles often have settling rates in water or friction-reduced water that compare with the annular velocity that can be achieved (e.g., 8 mesh sand falls at about 8"/sec through water). Stiffer gels or foam are typically required to limit the fall rate of large particles. Cleaning vertical wells in the overbalanced condition typically requires a fluid that has some leak-off control or blocking properties. A stiffer gel or foam is often used to control leak-off. Producing the well during the cleanout can help keep a well under balanced and minimize nitrogen consumption. However, the well production does nothing to help clean the rat hole beneath the perforations and results in additional flow up the production tubing, so causing additional friction pressure. Again the engineered solution of the instant invention based on computer modeling can take such factors into account and recommend the cost effective solution.

Figure 5:
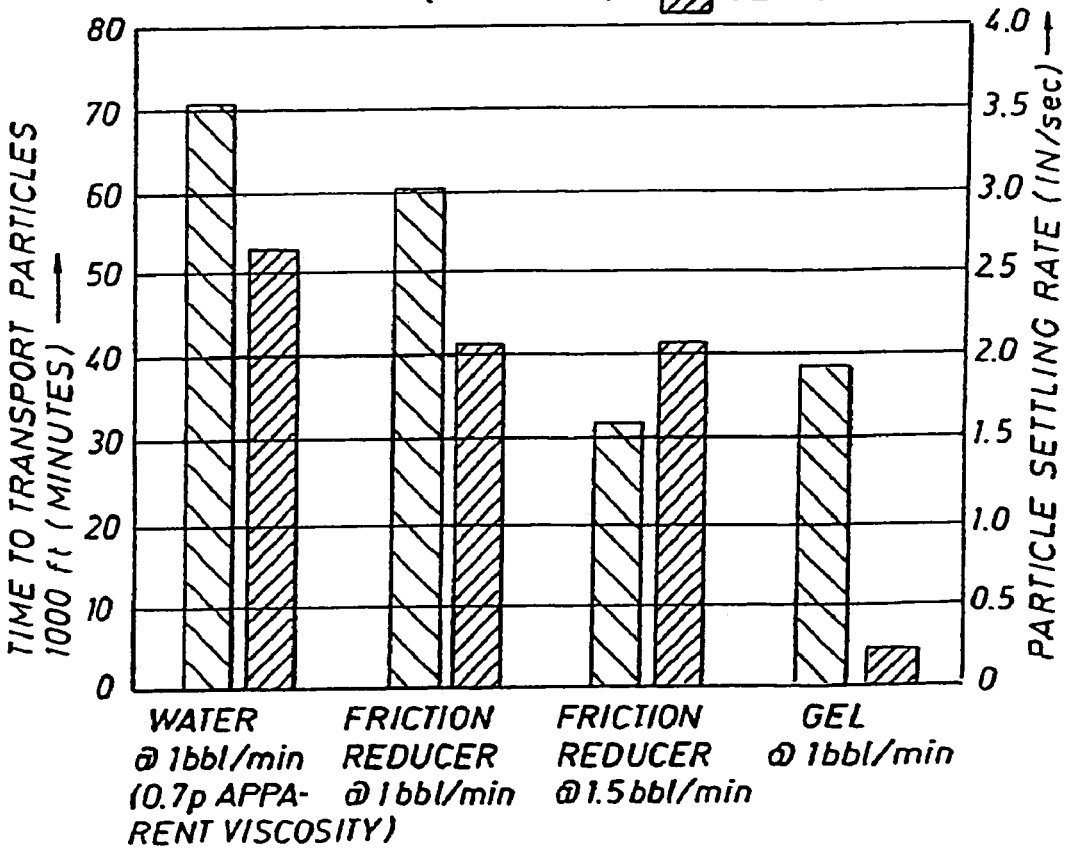
FIG. 5 (Prior Art)
FIG. 5 is a chart that illustrates the time to transport particles 1000 feet vertically with different cleanout fluids.

As illustrated by the chart of FIG. 5, cleaning 420 micron (40 mesh) sand out of a 7" liner requires over 70 minutes to move fill 1,000 ft up the wellbore when pumping water at 1 bbl/min. Using friction reducers and maintaining the same flow rate reduces this time by 15 minutes. Taking advantage of the lower friction pressures by pumping faster reduces the total time by another 30 minutes. Increasing the gel loading to higher levels often creates more delays and leads to complications with high pump pressures, annular choking and surface separation problems. Thus cleanouts using well assist require careful engineering to ensure that:

The lift velocities are sufficient beneath the perforations,

The friction pressures are not too high in the completion, and

The velocities are not too high in the completion or surface pipework, causing erosion.

The instant invention helps minimize all these potential problems through detailed engineering design and modeling.

Figure 6:
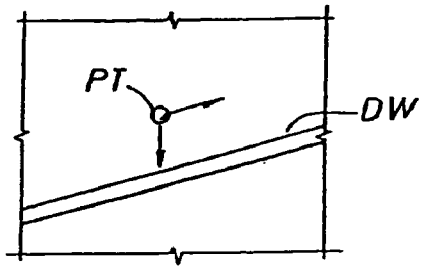
FIG. 6 (Prior Art)
FIG. 6 illustrates the forces on a particle in a deviated well.

Deviated and horizontal wells typically present a much greater challenge than vertical wells. Further, the presence of the coiled tubing on the low side of the wellbore disrupts the fluid velocity profile, causing a stagnant area where gravitational forces dominate and settling can occur. Thus, it is not sufficient to simply ensure that the fluid velocity exceeds the fall rate of the particulates. FIG. 6 illustrates that, transporting a particle PT 300 ft along a deviated hole DW with a fluid moving at a uniform rate, say 6"/sec, requires the fluid to suspend the particle for a significant time period. If the particle only has to settle 3" to hit the low side of the well, the settling rate has to be as low as 0.005 inches/sec. Many fluid velocity profiles are not uniform and thus particle suspension must be significantly higher than this simple example predicts. However, as settled beds build up, the effective narrowing of the annulus raises the velocity of the fluid significantly. In this manner an equilibrium bed size can be reached wherein the fluid velocity becomes so high that particles no longer settle.

Figure 7:
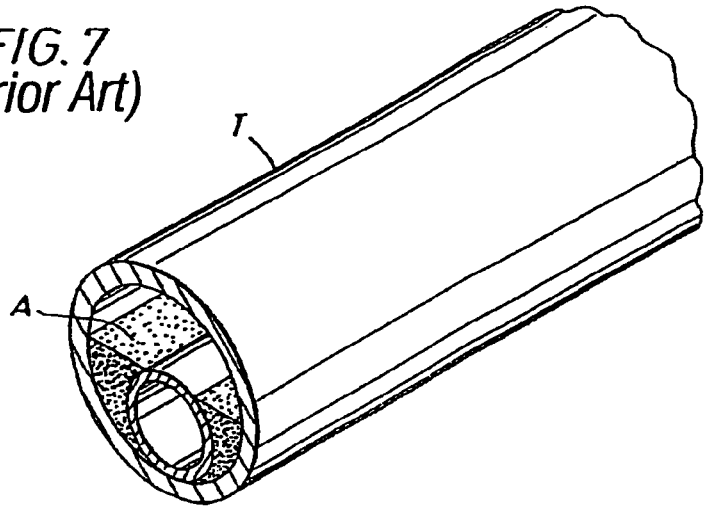
FIG. 7 (Prior Art)
FIG. 7 illustrates the formation of a sand bed around tubing in the annuls of deviated tubing.

FIG. 7 illustrates that in a 2⅞" completion, the volume of sand S that can be left partially filling the annulus A formed by 1¼" tubing T resting in a 5,000 ft long deviated section of a well W can easily fill 100 ft of 7' casing.

Many factors affect solids transport. One of these is the cleanout fluid. High performance biopolymers as cleanout fluids can have benefits in deviated wells. These polymers rely on high gel strength at low shear rates to achieve fill suspension and, under laminar flow conditions, have the ability to carry fill long distances along inclined well bores without depositing significant amounts of fill on the low side. However, at high shear rates these fluids "thin" considerably and, while shear thinning may help in keeping friction pressures down, particle suspension capability is significantly reduced.

The best combination of fluid properties and shear rate for cleaning a casting or liner may be unsuitable for smaller diameter production tubing. And as discussed above, leaving a shallow layer of fill in a deviated completion can result in a large volume of sand being left throughout the entire well bore, thus impeding future access into the well, reducing well production or requiring a repeat cleanout operation earlier than necessary. A further complication to be taken into account is that under eccentric annular flow conditions a significant quantity of the fill is transported much more slowly than the bulk speed of the fluid. Computation of particle slip thus can be crucial to ensure that sufficient hole volumes are pumped and that operations are not halted prematurely while particles are still in transit to the surface.

As a further consideration, viscous fluids are not well suited to picking up fill from a bed that has formed. In horizontal wells in particular, the sand bed must be physically disturbed to re-entrain the particles into the flow stream. This is often best achieved according to the present invention by using special purpose reverse circulating nozzles and an engineered sweep of the section by pulling the coil up while circulating. The speed of the sweep is calculated based on the sand bed height and the fluid properties and rate.

Low viscosity fluids circulated at high velocities can be very effective in cleaning long horizontal sections, especially where the best polymers are struggling to transport the fill without forming large sand beds. Only a high velocity, low viscosity fluid (such as friction-reduced water) can generate enough turbulence to pick up the fill particles once they have settled. Friction-reduced water has the additional advantages of being much cheaper than biopolymers and does not complicate the surface handling of the returns. Nitrogen is often added to the water to reduce the hydrostatic head of the fluid and also increase the velocities.

The optimum system for cleaning deviated and horizontal wells is very dependent on the exact well parameters. Particularly, extended reach wells can require very high circulation rates and large volumes of fluid to cleanout. Incorrect job design can result in the cleanout taking days longer than necessary or in only a small percentage of the fill being removed. Generally, the techniques and approaches of the instant invention, including back sweeping the fill using custom designed circulating nozzles and possibly including the slugging of different fluids and/or the intermittently pumping at high rates with the coil stationary to bypass coil fatigue constraints, can greatly reduce the cost and increase the effectiveness of deviated and horizontal well cleanouts.

The table of FIG. 9 illustrates typical cleanout fluids, their advantages, disadvantages and applications. Optimizing any coiled tubing cleanout job requires careful fluid selection. The fluid must not be only the most appropriate to the cleanout technique chosen but it must also have the necessary performance under downhole conditions. For example:

Polymer gels generally thin at higher temperatures and higher shear rates. The gel properties downhole must be understood.

Foaming agents are affected by downhole temperature and downhole fluids. The foaming agent must be compatible with all the fluids that might be present in the wellbore.

Figure 8:
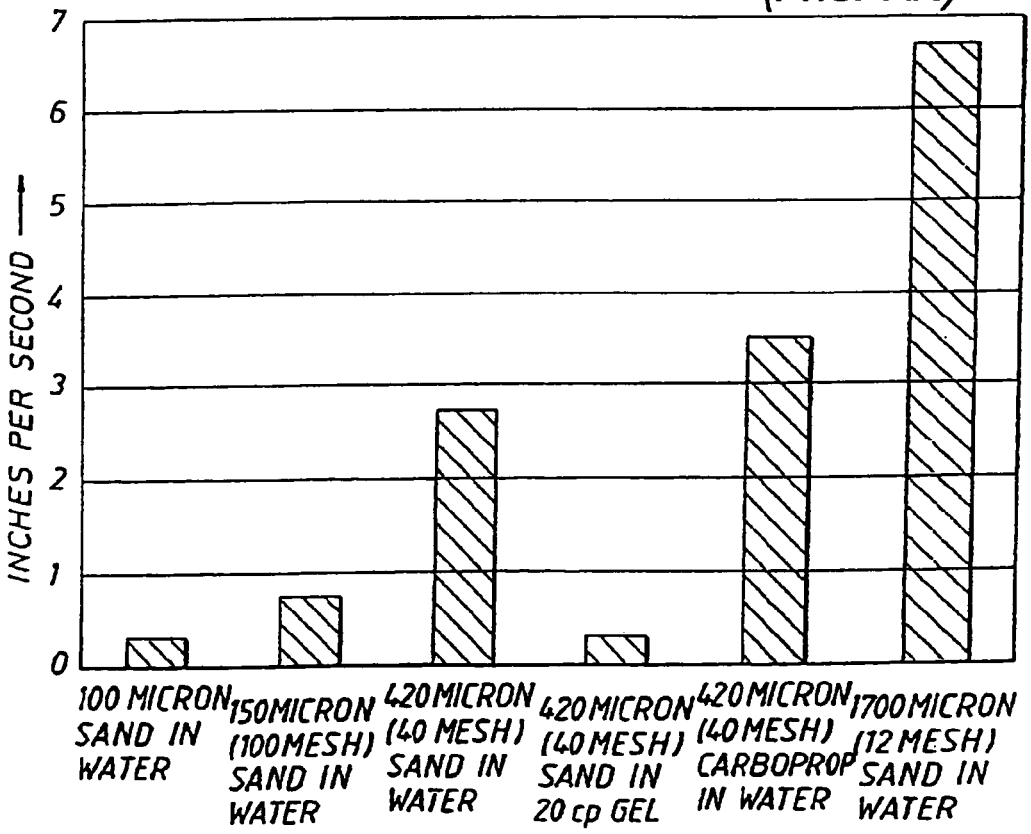
FIG. 8 (Prior Art)
FIG. 8 is a table that illustrates particle vertical fall rates.

The particulate fall rate as measured in a fluid can vary greatly depending on the particle size, shape and density, and the density and viscosity of the fluid. Bigger particles fall faster than smaller particles and even slightly viscous fluids greatly hinder particle settling. In some cases, cleanouts may lift the small particles out of the well, leaving the larger ones behind. The table of FIG. 8 illustrates particle fall rates.

Computer modeling in accordance with the instant invention, including simulation and analysis, represents an accurate and powerful design tool available for coiled tubing cleanouts. Understanding the requirements for cleanouts may be all for naught if the friction pressures, flow rates and well production performance cannot be modeled accurately. In accordance with the instant invention, modeling can accurately predict the flow regimes, velocities and friction pressures at all points along the well bore and down the coiled tubing. The system preferably models the forces and stresses of the coiled tubing to ensure that the coil limitations are not exceeded, either by pressure or by bucking forces experienced in high angle wells. Real time analysis using computer modeling at the well site allows engineers to quickly recognize changing or unforeseen conditions in the well, such as changes in bottom hole pressure (BHP) or well productivity. The job design can then be immediately altered to reflect the new design, ensuring continuing safe and efficient operations. Real-time data allows operators to match or update original job predictions. Preferably the modeling of the instant invention incorporates two-phase flow within force analyses, predicts time-to-failure when hitting obstructions, uses BHP, surface pressure and two-phase flow to make accurate predictions, offers highly stable, rapid computation for reliable performance and is user-friendly and easy to run in the field.

Effectively reducing the TCO (total cost of operations) attributable to CT well cleanouts requires a long-term perspective on the issue. As discussed above, spending less on each job but performing more cleanout jobs can, over time, be the most costly route. It is important to define the operational variables and understand the significant cost drivers for each situation. Computer modeling analysis in accordance with the instant invention yields comprehensive CT job plans to help reach goals. The instant invention, in preferred embodiments, offers:

Accurate, thorough CT job designs
Real-time, on-site job monitoring
More complete debris removal
Optimized fluid design
Optimized equipment selection
Optimized nitrogen consumption
Longer intervals of obstruction-free production
Reduced total cost of operation.

The instant invention offers a complete package—an engineered approach to coiled tubing cleanouts for maximum operational success.

The instant invention may include one of an array of specialized tools to enhance cleanout operations, including in particular high efficiency jetting nozzles. For instance, preferred embodiments could have a vortex nozzle secured onto the end of a dual switching nozzle to induce swirling into jetting. Proper tools help the instant invention solve cleanout problems in the most cost-effective manner, in general.

In some instances fill will be compacted. In this situation, a simple wash nozzle may not have enough jetting power to break up fill. The fill cannot be lifted out of the well until it is first broken apart. The instant invention has developed a high velocity/high efficiency-jetting nozzle, FIG. 10A referred to herein as the Tornado tool. This tool provides high-energy jets with greater destructive power than conventional wash nozzles. This tool is specifically designed by BJ Services Company, Houston, Tex., for cleanout operations. The tool has both forward and rearward facing jets. The jetting fluid is diverted either predominately forward or predominately backward, depending upon whether the tool is jetting down into compacted fill or being used to "sweep" fill up the well on the low side of a wellbore. Engineering algorithms calculate how fast the coil can be run into the fill and how fast the coil can be "swept" back up the well in conjunction with the tool. Running in too fast could result in too large a sand bed being deposited behind the tool; pulling up too fast could result in fill being bypassed and left behind as the tool is pulled back to surface.

The technology of the instant invention can greatly reduce the time required for the more challenging cleanouts and provide protection against coil becoming stuck in the well due to sand compacting behind the jetting nozzles.

The instant invention further contemplates in some embodiments using a downhole separator to split a mixture of gas and liquid, sending the gas to the annulus to lighten the column and sending the liquid to the tool below. Compressible fluids often do not make good jetting fluids, as the jet does not remain coherent. The expanding gas, in effect, blows apart the streaming fluid. The use of a downhole separator above a vortex nozzle allows powerful liquid jets to be utilized even though co-mingled fluids are pumped through the coil.

FIGS. 10A-10G illustrate preferred embodiments of nozzles, including a Tornado tool, as used with the instant invention. FIGS. 10A-10D illustrate one embodiment of a dual nozzle N, the Tornado tool. The nozzle includes forward facing jets FFJ and rearward facing jets RFJ. It may be seen that the forward facing jets have a smaller orifice as compared to the rearward facing jets. Thus, forward facing jets FFJ are designed in the embodiments of FIG. 10 to provide a high-pressure drop, or to compromise high energy jets. Rearward facing jets are dimensioned with larger orifices to provide low energy, or to compromise low pressure jets.

Figure 10A:
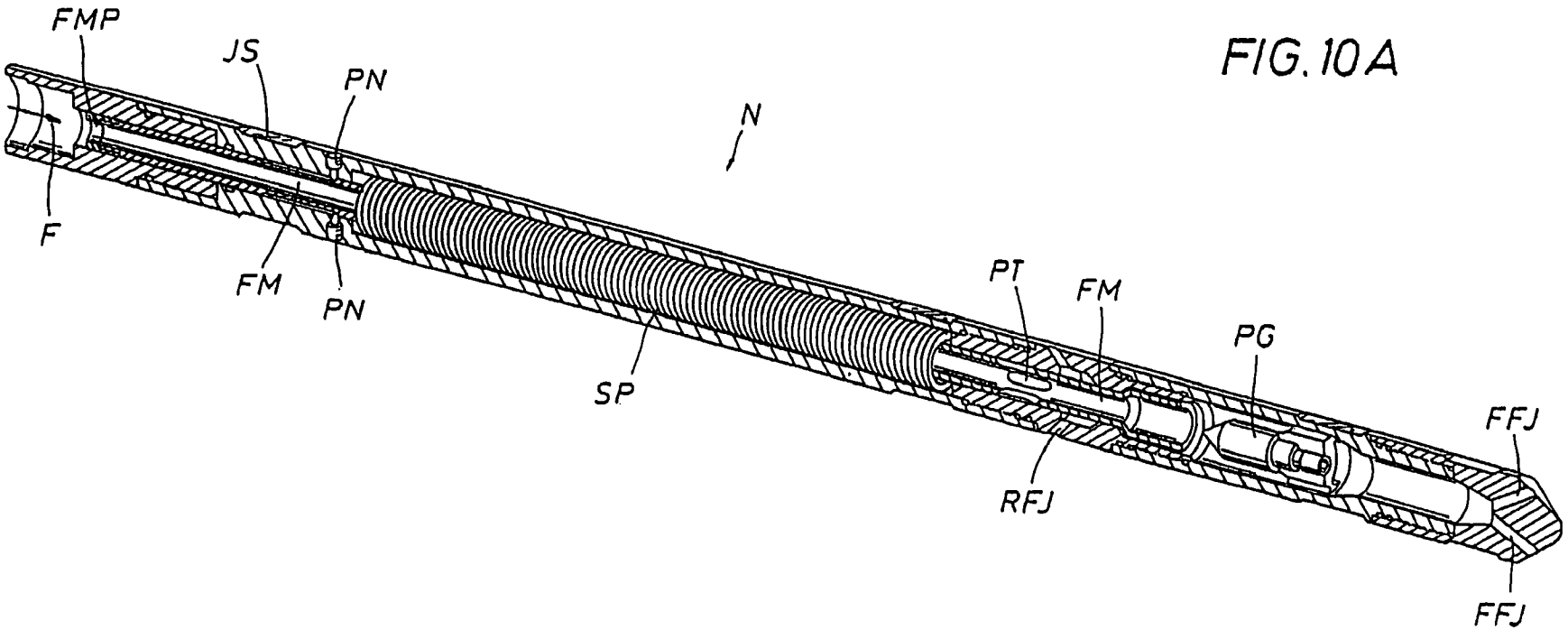
FIG. 10 illustrate preferred cleanout nozzles of the instant invention.
Figure 10B:
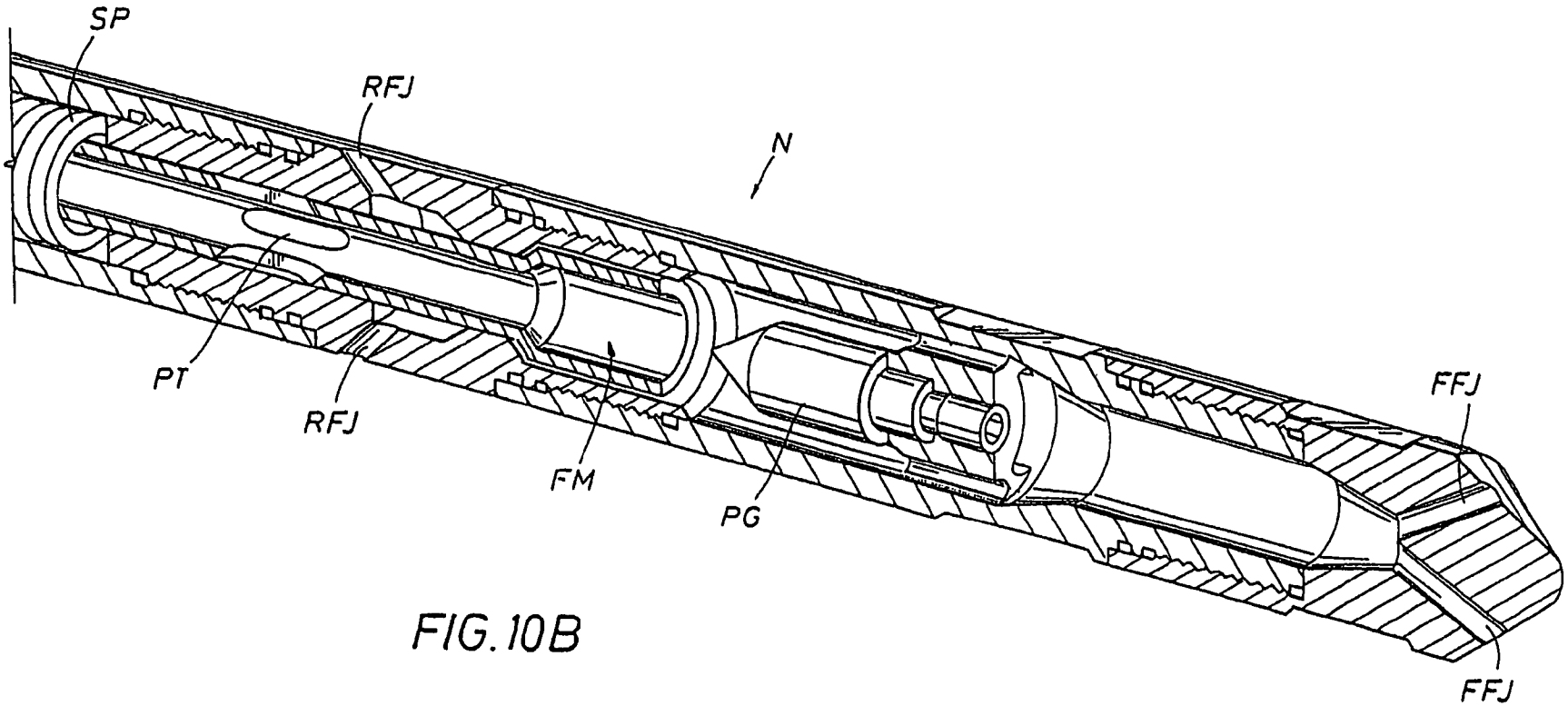
Figures 10C, 10E:
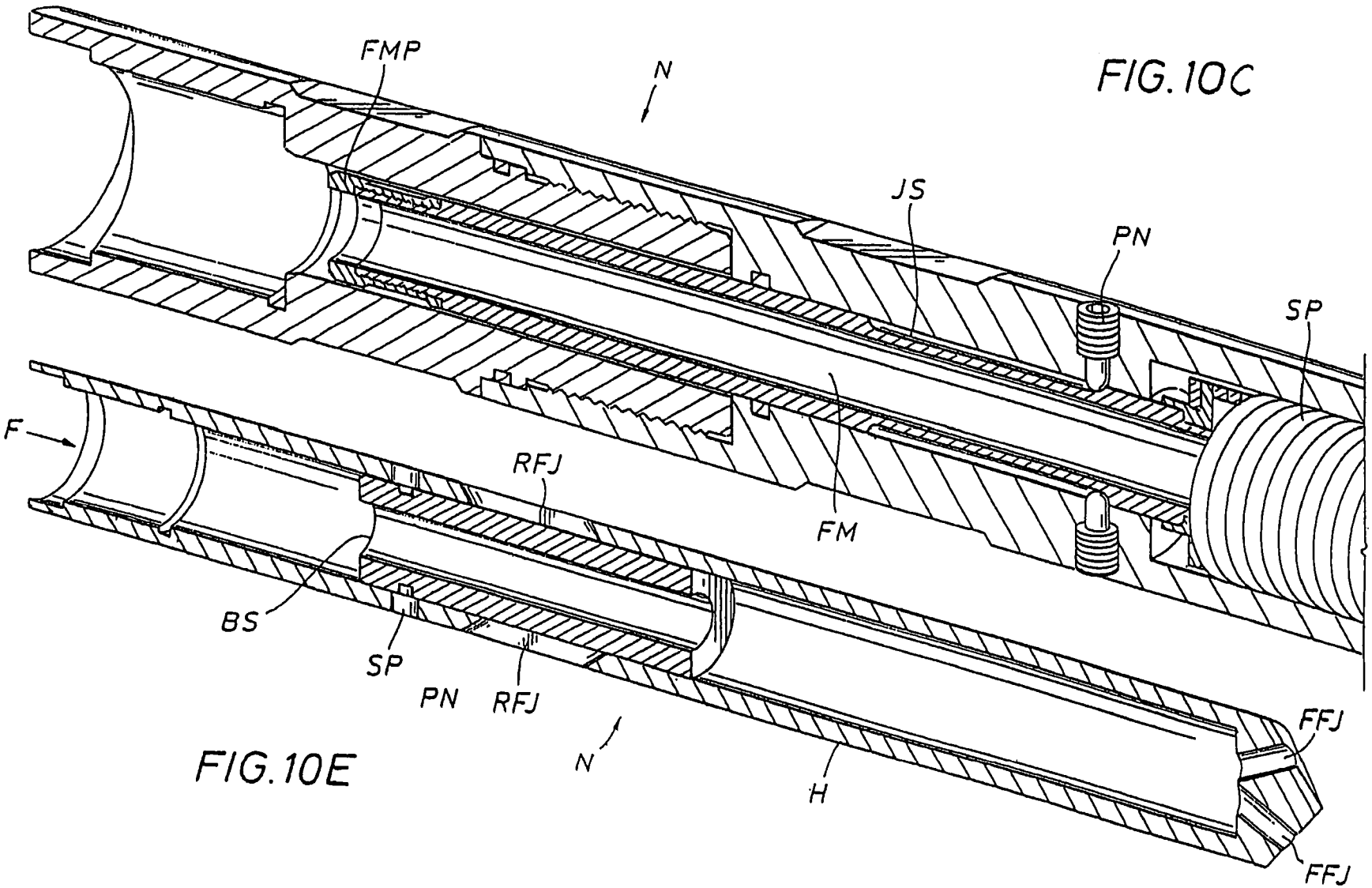
Figure 10D:
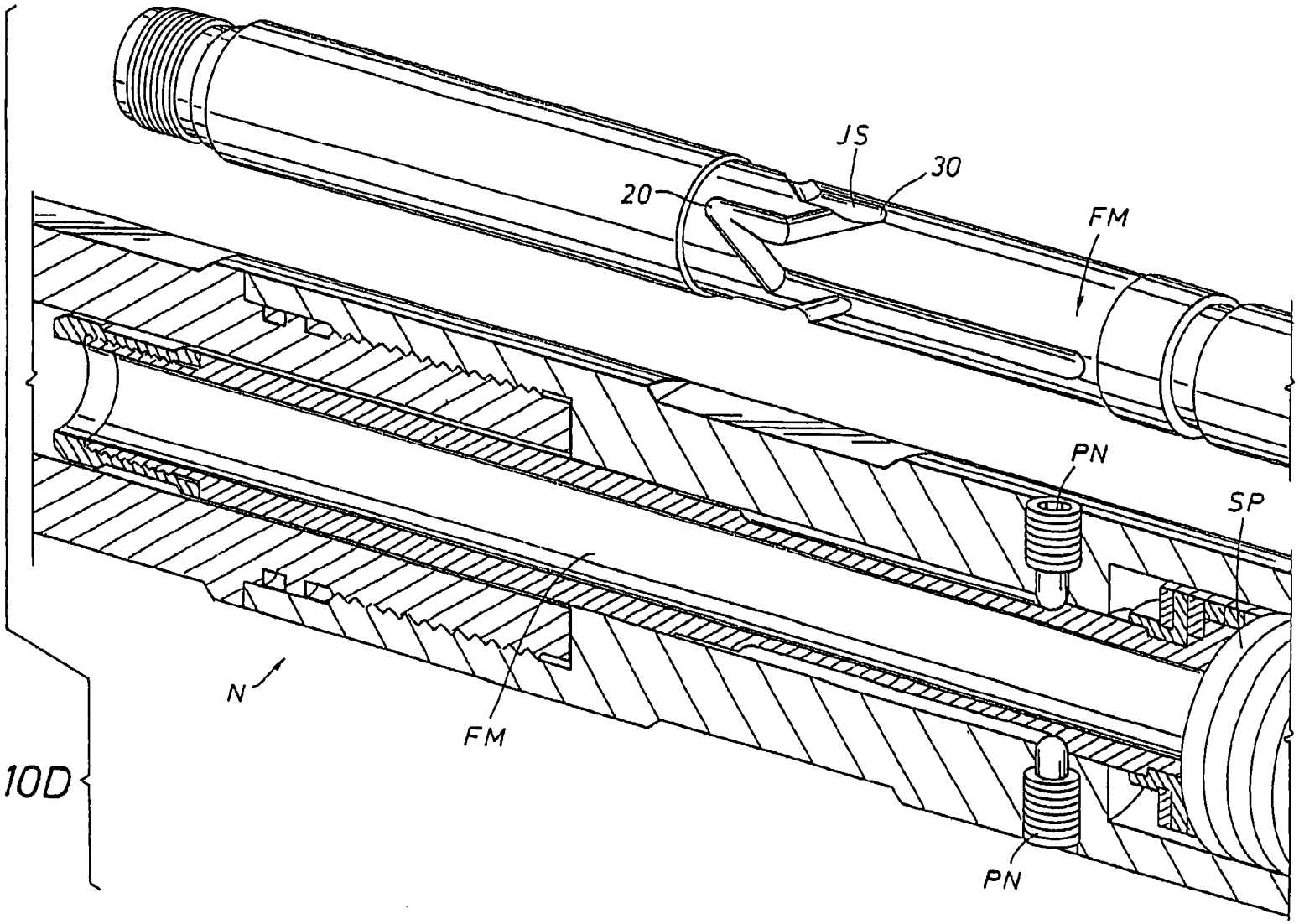

FIG. 10A illustrates the Tornado nozzle N with flow mandrel FM in its uphole spring biased position. In such position fluid F flows through the nozzle and mandrel FM and out forward facing jets FFJ. Rearward facing jets RFJ are occluded by portions of flow mandrel FM in the flow mandrel's spring biased most uphole position. Spring SP biases flow mandrel FM in its uphole or rearward position. When flow through nozzle N is increased to a predesigned amount, pressure on annular piston shoulder FMP of the flow mandrel, given the pressure drop through flow mandrel FM, overcomes the biasing force of spring SP and flow mandrel FM moves to the right in the drawing, to its forward or downhole position. As flow mandrel FM moves downstream the forward or downstream end of the flow mandrel relatively tightly receives plug PG. A very small gap may be designed between the inner diameter of lower end of flow mandrel FM and plug PG, such that perhaps 1% of the fluid may continue to dribble through flow mandrel FM and reach the forward facing jets. However, the bulk of the fluid in flow mandrel FM, when the flow mandrel has moved to its forward or downstream position against spring SF, now flows through ports PT and out rearward facing jets RFJ. FIG. 10B illustrates the forward or downstream end of nozzle N in larger detail. FIG. 10C illustrates the upstream or rearward end of nozzle N in larger detail. As flow mandrel FM moves to the right in the drawings, or moves forward or downstream, pins PN ride in J slots JS on the outer surface of flow mandrel FM. FIG. 10D offers an illustration of J slots JS in greater detail. From FIG. 10D it can be seen that as flow mandrel FM moves forward, pins PN slide in J slot JS from an initial upmost position 10 to a maximum increased flow rate position 20. When pressure is then decreased, pins PN move in J slots JS to position 30, which is a lowermost position for rearward jetting. It can be appreciated that if pressure is again increased, pins PN can continue to traverse J slots JS such that flow mandrel FM can be returned to its original upmost position for forward jetting. In that position pins PN would again return to a position analogous to indicated position 10 in J slot JS.

In general, to operate the preferred embodiment of FIGS. 10A-10D, the Tornado nozzle tool would be run in hole with the flow mandrel in the uppermost position. Such position would allow forward jetting wash nozzles to be exposed. Running in hole, thus, would include washing and/or jetting the hole through the forward jetting wash nozzles. At target depth, the Tornado nozzle tool could be switched to close the forward nozzles and expose the rearward nozzles. Switching is achieved by increasing the flow rate, and therefore the pressure drop, through the flow mandrel. This increase in pressure drop creates a downward force on the flow mandrel to overcome the spring force. A J slot in the flow mandrel then controls the final position of the flow mandrel, once the pressure drop is reduced by decreasing the flow rate. The flow mandrel, thus, typically resides in a rearward position with pins PN engaging J slot JS at approximate position 10, or in a forward position with pins PN engaging J slot JS in a more rearward position 30. Therefore, by increasing and then decreasing the flow rate the tool can be cycled between a forward jetting and a rearward jetting position.

Figures 10F, 10G:
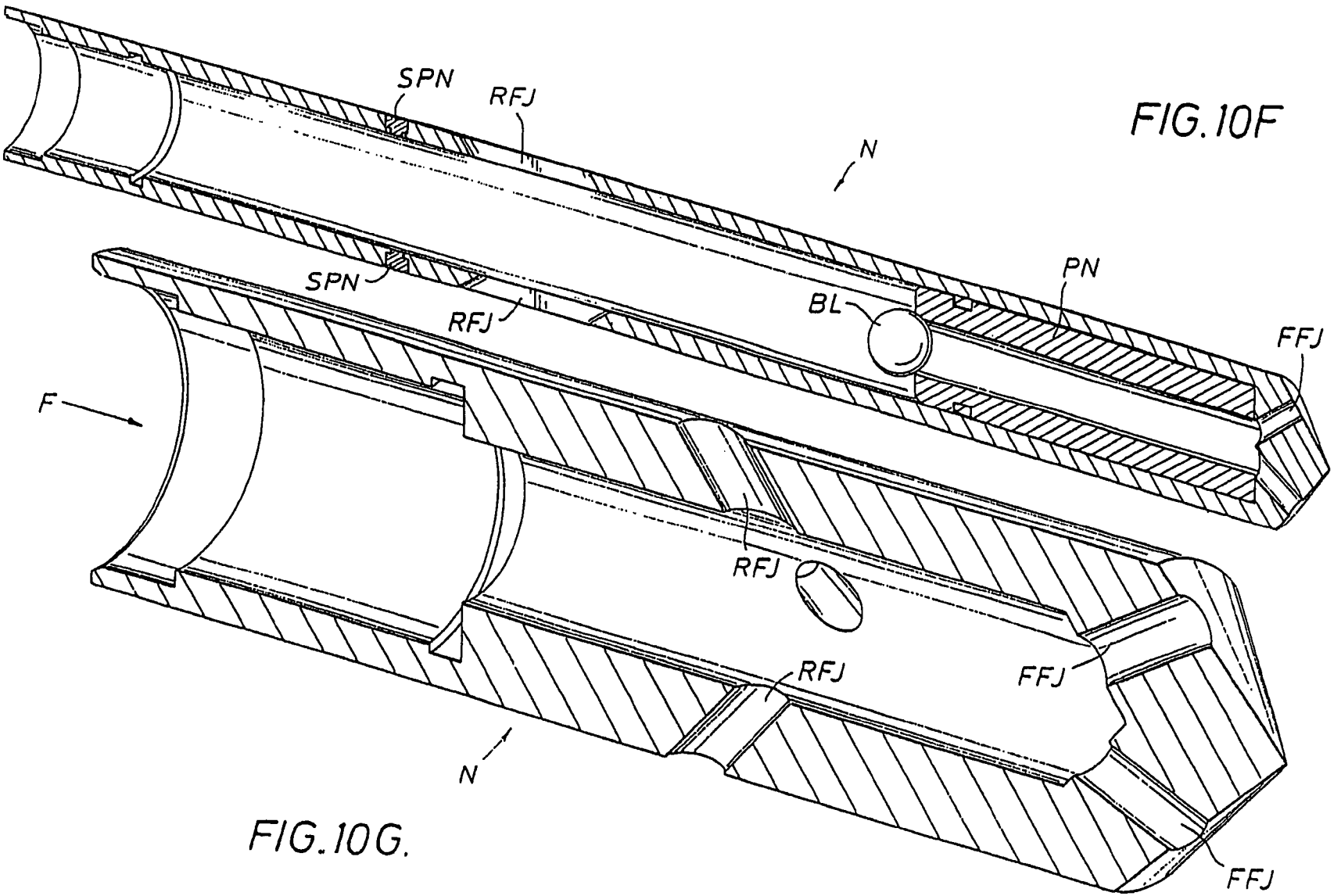

FIGS. 10E and 10F illustrate a second simpler embodiment of a jetting nozzle. FIG. 10E illustrates the nozzle with piston PN locked by shear pins SP in a rearward or uphole position blocking rearward jetting nozzles RFJ. Fluid flowing through this nozzle exits forward jetting nozzles FFJ, as illustrated in FIG. 10E. When ball BL is sent down the tubing and into the nozzle, ball BL seats upon piston PN shearing shear pins SP and sending piston PN with ball BL to seat upon the end of nozzle N. In such position fluid is blocked to forward facing jets FFJ and exits rearward facing jets RFJ.

FIG. 10G illustrates a simpler work nozzle providing for no switching. All fluid flowing through nozzle N in FIG. 10G will exit both rearward facing jets RFJ and forward facing jets FFJ at all times.

EXAMPLE

Wiper trips are a conventional field practice to clean a hole of sand in cleanout operations. A wiper trip can be defined as the movement of the end of coiled tubing in and out of the hole, at least a certain distance. In order to clean solids out of the wellbore, a proper wiper trip speed should be selected based on operational conditions. There is no previously published information related to the selection of the wiper trip speed. In this study, numerous laboratory tests were conducted to investigate wiper trip hole cleaning and how hole cleaning efficiency is influenced by solids transport parameters such as; a) nozzle type, b) particle size, c) fluid type, d) deviation and, e) multi-phase flow effect. The results indicate the following:

1. Compared with stationary circulation hole cleaning, the use of the wiper trip produces a more efficient cleanout.
2. For a given operational condition, there is an optimum wiper trip speed at which the solids can be completely removed in the fastest period of time.
3. Nozzles with a correctly selected jet arrangement yield a higher optimum wiper trip speed and provide a more efficient cleanout.
4. The hole cleaning efficiency is dependent on the deviation angle, fluid type, particle size, and nozzle type.

Correlations have been developed that predict optimum wiper trip speeds and the quantity of solids removed from and remaining in a wellbore for given operating conditions. The wiper trip provides an advantage for hole cleaning and can be modeled to provide more efficient operations.

Solids transport and wellbore cleanouts can be very effective using coiled tubing techniques if one has the knowledge and understanding of how the various parameters interact with one another. Poor transport can have a negative effect on the wellbore, which may cause sand bridging and as a result getting the coiled tubing stuck. Coiled tubing then can be a very cost-effective technology when the overall process is well designed and executed. The proliferation of highly deviated/horizontal wells has placed a premium on having a reliable body of knowledge about solids transport in single and multi-phase conditions.

In our previous studies, (Li, J. and S. Walker: "Sensitivity Analysis of Hole Cleaning Parameters in Directional Wells," paper, SPE 54498 presented at the 1999 SPE/ICoTa Coiled Tubing Roundtable held in Houston, Tex., 25-26 May 1999; Walker, S. and J. Li: "Effects of Particle Size, Fluid Rheology, and Pipe Eccentricity on Cuttings Transport", paper, SPE 60755 presented at the 2000 SPE/ICoTa Coiled Tubing Roundtable held in Houston, Tex., 5-6 Apr. 2000) a comprehensive experimental test of solids' transport for stationary circulation was conducted. The studies included the effect of liquid/gas volume flow rate ratio, ROP, deviation angle, circulation fluid properties, particle size, fluid rheology, and pipe eccentricity on solids transport. Said papers are herein incorporated by reference and familiarity with those studies is presumed. Based on the test results the data was therein analyzed, correlation's were developed, and a computer program was developed.

In this study, simulated wiper trip hole cleaning effectiveness was investigated with various solids transport parameters such as deviation angle, fluid type, particle size, and nozzle type. Based on these test results, an existing computer program was modified and adjusted to include these additional important parameters and the effect on wiper trip hole cleaning.

Figure 11:
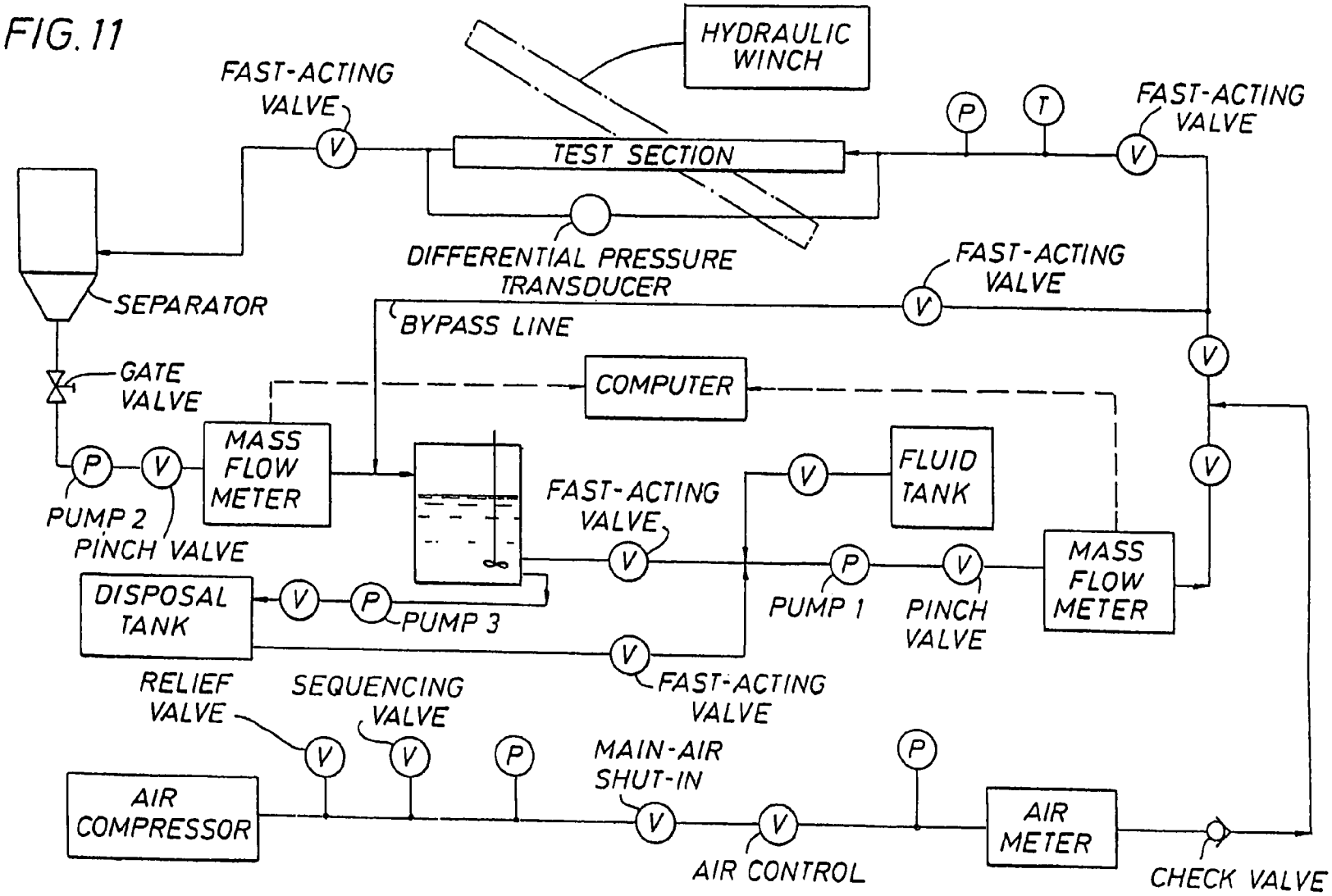
FIG. 11 is a scheme for a cuttings transport flow loop for experiments related to the instant invention.
Figure 12:
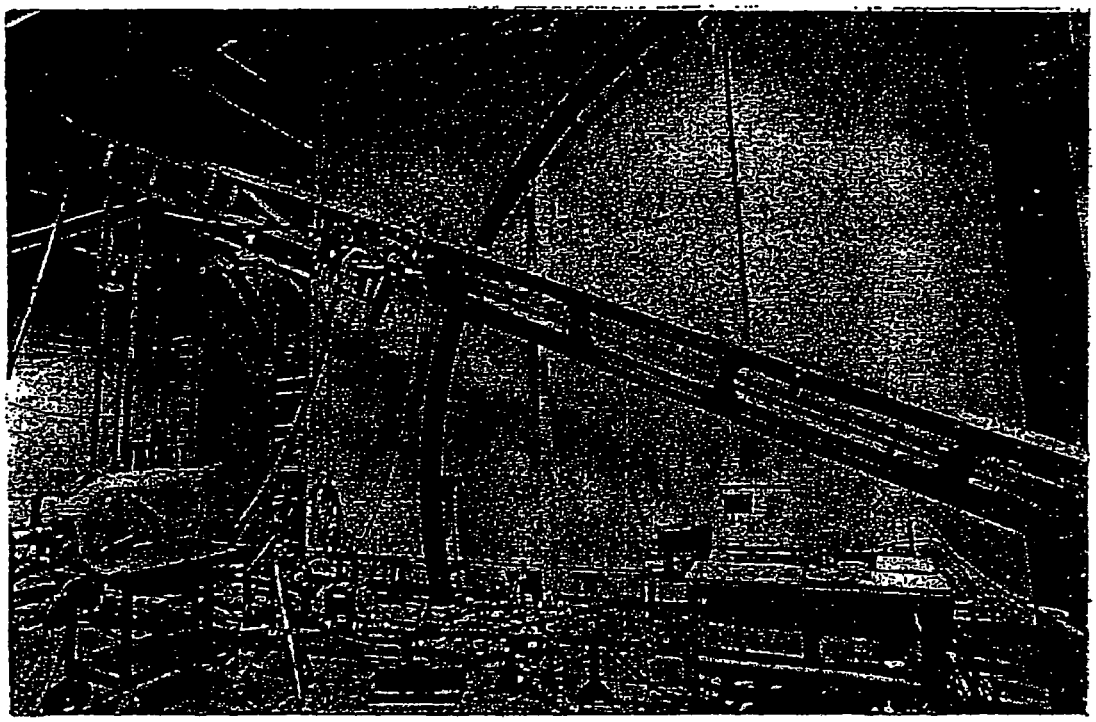
FIG. 12 is a photo of horizontal transport flow loop used in experiments relating to the instant invention.

The flow loop shown in FIG. 11 was used for this project. It was developed in the previous studies, referenced above. The flow loop has been designed to simulate a well bore in full scale. This flow loop consists of a 20 ft long transparent lexan pipe with a 5-inch inner diameter to simulate the open hole and a 1½" inch steel inner pipe to simulate coiled tubing. The flowloop was modified and hydraulic rams were installed to enable movement of the tubing (see FIG. 12). The inner pipe can be positioned and moved in and out of the lexan to simulate a wiper trip. The loop is mounted on a rigid guide rail and can be inclined at any angle in the range of 0°-90° from vertical.

When the coiled tubing is in the test section, the methodology encompasses circulating the sand into the test section and building an initial sand bed with an uniform height cross the whole test section. Then the methodology includes pulling the coil out of the test section with a preset speed.

The recorded parameters include flow rates, initial sand bed height before the coiled tubing is pulled out of the hole (POOH), and final sand bed height after the coil tubing is POOH, fluid temperature, pressure drop across the test section and wiper trip speed. The data collected from the instrumentation is recorded using a computer controlled data acquisition program. (See references above for more information.)

RESULTS AND DISCUSSION

In this study (see above references regarding particle size), over 600 tests have been conducted to date using three different particle sizes over a range of liquid and gas rates and at angles of 65° and 90° from vertical. The way in which the wiper trip affects the various solids transport parameters was investigated. The results and discussion focus on the situation that involves wiper trip hole cleaning in which the tubing is pulled out of the hole while circulating water, gel, and multiphase gas combinations.

The study focused on the wiper trip situation of pulling the coiled tubing out of the hole. The critical velocity correlation developed in a previous study (see above references) can be used to predict the solids transport for the coiled tubing run-in-hole (RIH).

The wiper trip is an end effect. When the circulation fluids are pumped down through the coil and out of the end and returned to surface through the annulus, the flow changes direction around the end of the coil and the jet action only fluidizes the solids near the end of the coil. When the flow conditions are less than the critical condition solids will fall out of suspension for a highly deviated wellbore.

Figure 13:
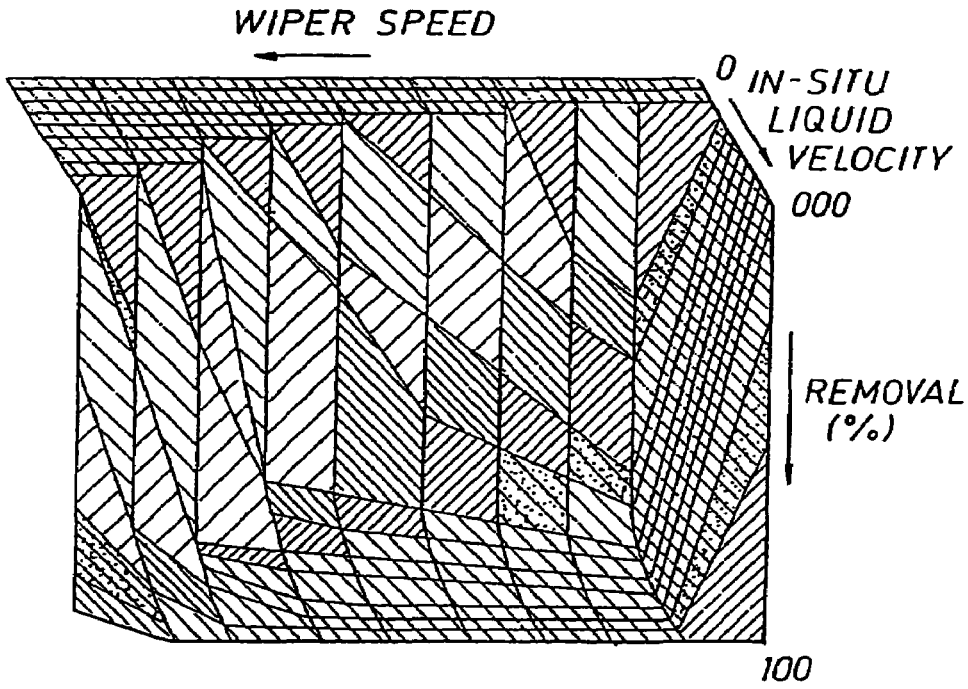
FIG. 13 is a chart illustrating the effect of wiper trips speed and flow rate on hole cleaning efficiency in experiments relating to the instant invention.

Based on the experimental observation in this study, for a given set of conditions, there is an optimum wiper trip speed at or below which sands can be removed completely when the coil is pulled out of the hole. When the coil tubing is POOH at a wiper trip speed higher than the optimum wiper trip speed, there is some sand left behind. In general, more sand is left in the hole as the wiper trip speed is increased. The hole cleaning efficiency is defined as the percentage of sand volume removed from the hole after the wiper trip versus the initial sand volume before the wiper trip. 100% hole cleaning efficiency means that the hole was completely cleaned. In general a higher pump rate results in a higher optimum wiper trip speed. The vertical axis of FIG. 13 is equal to 100% minus the hole cleaning efficiency. For a given type of nozzle and deviation angle, there is a minimum flow rate at which the hole cleaning efficiency is near to zero. For low pump rate, the remaining sand volume in the hole increases non-linearly with the dimensionless wiper trip speed. However, with high flow rate the remaining sand volume in the hole increases linearly with the dimensionless wiper trip speed. FIG. 13 displays these three parameters that can be correlated and used to select adequate flow rates and wiper trip speed to ensure an effective cleanout operation. Again, if the pump rate is too low or the coiled tubing is pulled out of the hole too fast, solids will be left behind. There are other variables, which can affect the hole cleaning effectiveness during wiper trip cleanouts. The effect of the following variables are investigated in this study:

1. Nozzle type
2. Particle size
3. Fluid type
4. Deviation angle
5. Multi-phase flow effect Effect of nozzle type. In this study three different nozzle types were investigated. For simplicity the nozzles can be referred to as Nozzle A, B, and C. Each of these three nozzles had different jet configurations and size. The effective wiper trip hole cleaning time was investigated for each nozzle type and the optimum wiper trip speed for a wide range of flow rates was determined. Previous 'rules of thumb' assumed that the cleanout of a well bore takes approximately two hole volumes for a vertical wellbore. From these experimental studies, it has been observed that these 'rules of thumb' are inadequate.

Figure 14:
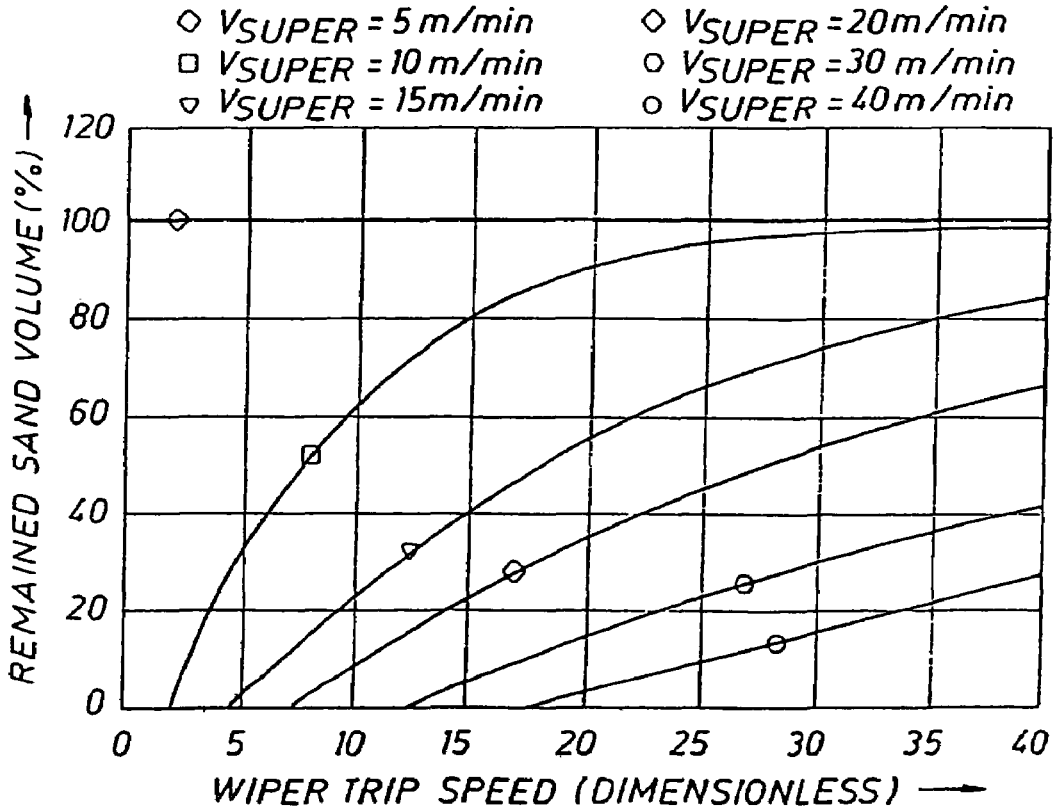
FIG. 14 is a chart illustrating hole cleaning efficiency for water at 90° with a particular nozzle selection, as relating to experiments in connection with the instant invention.
Figure 15:
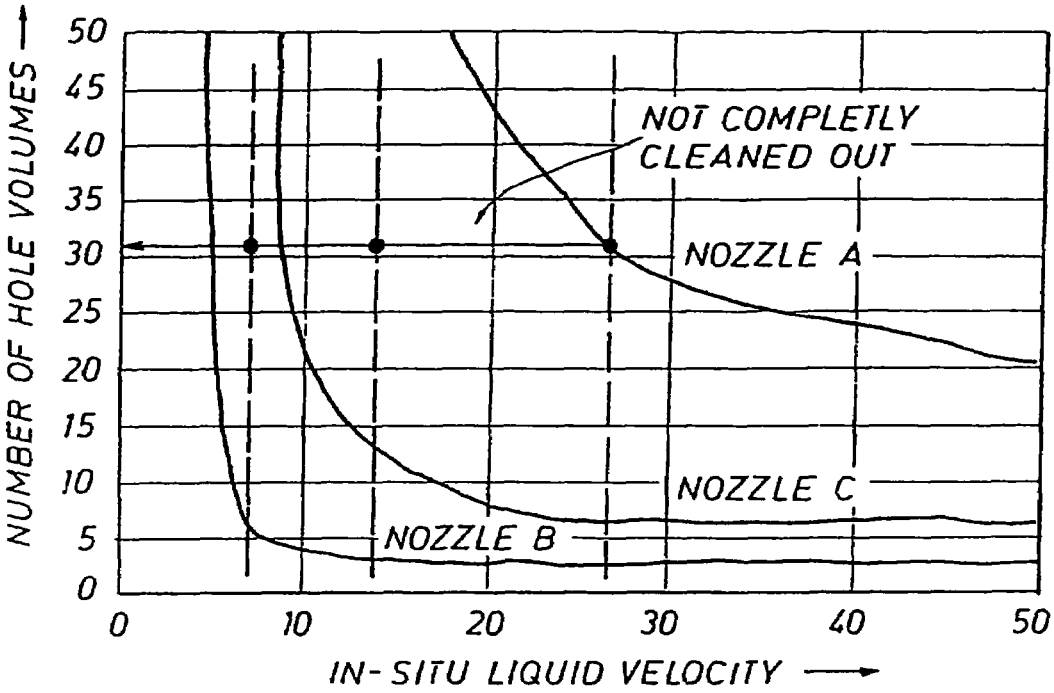
FIG. 15 illustrates effective hole cleaning volume with different nozzles types of water at a horizontal wellbore in experiments associated with the instant invention.

FIG. 15 displays the number of hole-volumes required to clean the hole using water in a horizontal section of a well for the three different nozzle types. There is a non-linear relationship between the number of hole volumes and the in-situ liquid velocity. For a given type of nozzle, the number of hole-volumes needed is constant when the in-situ liquid velocity is high enough. However with a low in-situ liquid velocity, the number of hole-volumes increases dramatically with the decreasing of the pump rate. An important thing to note is that, in certain ranges, the hole will not be sufficiently cleaned out if the minimum in-situ velocity is not attained and this value may vary depending on the type of nozzle. It is essential to select a proper nozzle configuration and wiper flip speed to ensure an effective cleanout. The solids transport parameters that are interacting with one another (shown in FIGS. 14 and 15) can be correlated using a dimensionless wiper trip speed parameter. From this information proper nozzles, flow rates, and wiper trip speed can be selected to provide an effective cleanout.

Figure 16:
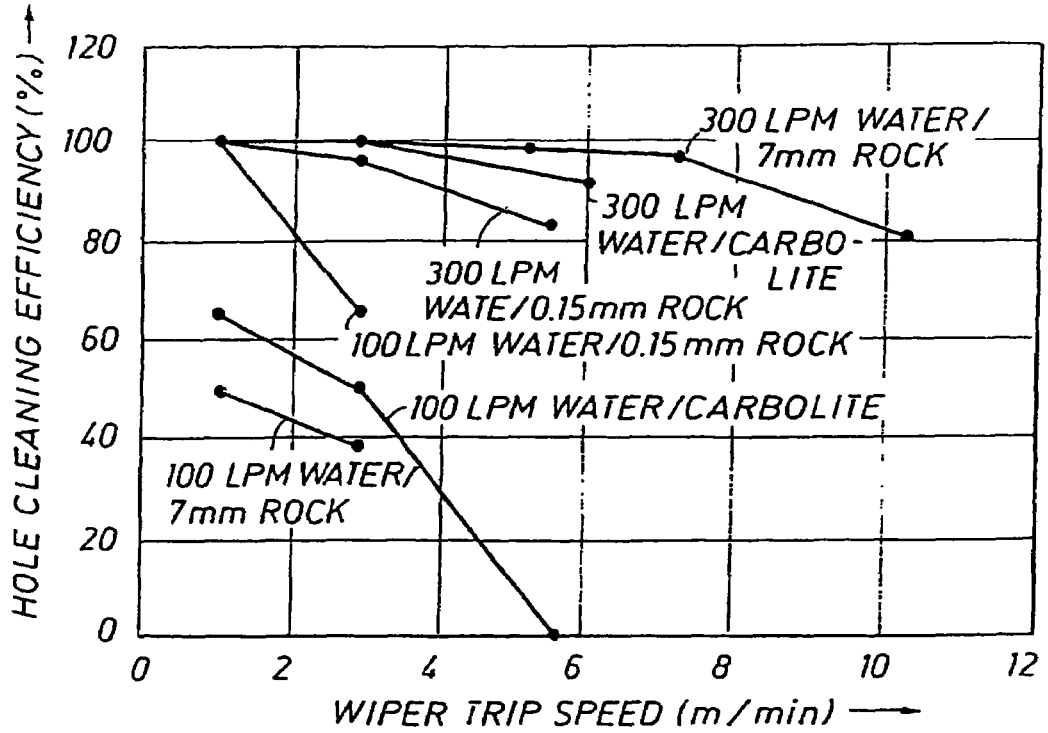
FIG. 16 illustrates effective sand type on hole cleaning efficiency with cleanout fluids at a horizontal wellbore in experiments associated with the instant invention.
Figure 17:
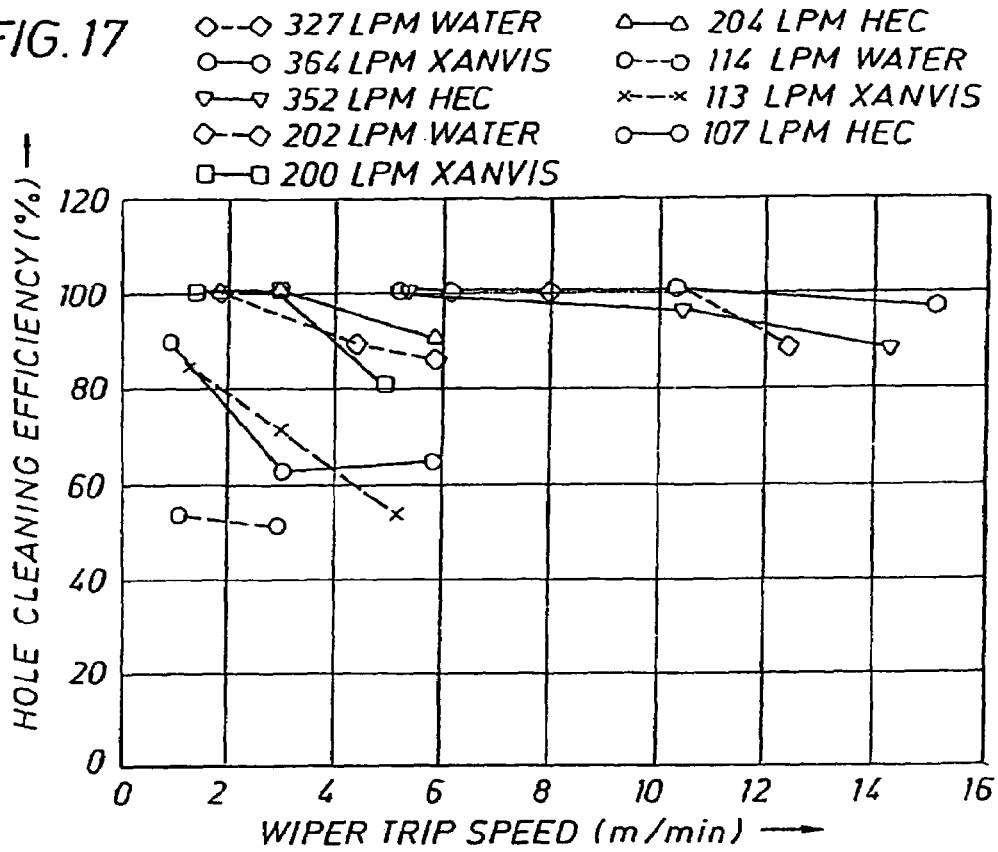
FIG. 17 illustrates the effective fluid type on the hole cleaning efficiency with particular cleanout fluids in a deviated wellbore in experiments associated with the instant invention.

Effect of particle size. The previous study results (see above references) indicate that there is a particle size that poses the most difficulty to cleanout with water for the stationary circulation mode, and from the study it is of the order of 0.76 mm diameter frac sand. In contrast to stationary circulation hole cleaning, the wiper trip hole cleaning situation reveals different conclusions based on particle size. In this study three types of particles ranging in size were investigated: 1) well bore fines, 2) frac sand, 3) drilled cuttings. FIG. 16 displays the results of the investigation of particle size that included a wide range, and the results suggest that for the horizontal well bore with a high pump rate, larger particles have a higher hole cleaning efficiency than smaller particles do. The results for low pump rate were the opposite.

The effect of particle size on solids transport is different between stationary circulation and wiper trip hole cleaning. Due to the complexity of the interaction between the various solids transport parameters it is a challenge to generalize and draw conclusions. For more information on particle size effects please refer to the above references.

Effect of fluid type. Wiper trip hole cleaning adds a new dimension with respect to fluid type. In contrast to stationary circulation hole cleaning, where gel could not pick up the solids and only flowed over the top of the solids bed (see above references), for the highly deviated wellbore the wiper trip hole cleaning method transports the solids effectively. Due to the turbulence created at the end of the coiled tubing from the fluid, gels have the ability to pick up and entrain solids and transport them along the wellbore. For small particles like wellbore fines, the use of gel for long horizontal sections is beneficial. The larger particles such as frac sand or drilled cuttings, tend to fall out at a more rapid pace.

The effect of fluid type on the hole cleaning efficiency is shown in FIG. 16. There is no significant difference between XANVIS and HEC for all tested flow rates. There is no difference between water and gel except for very low pump rates i.e. at very low shear rates, when gels outperform water/brines. Therefore, in the case where the liquid in-situ velocity is low, pumping gel would clean the hole better.

Figure 18:
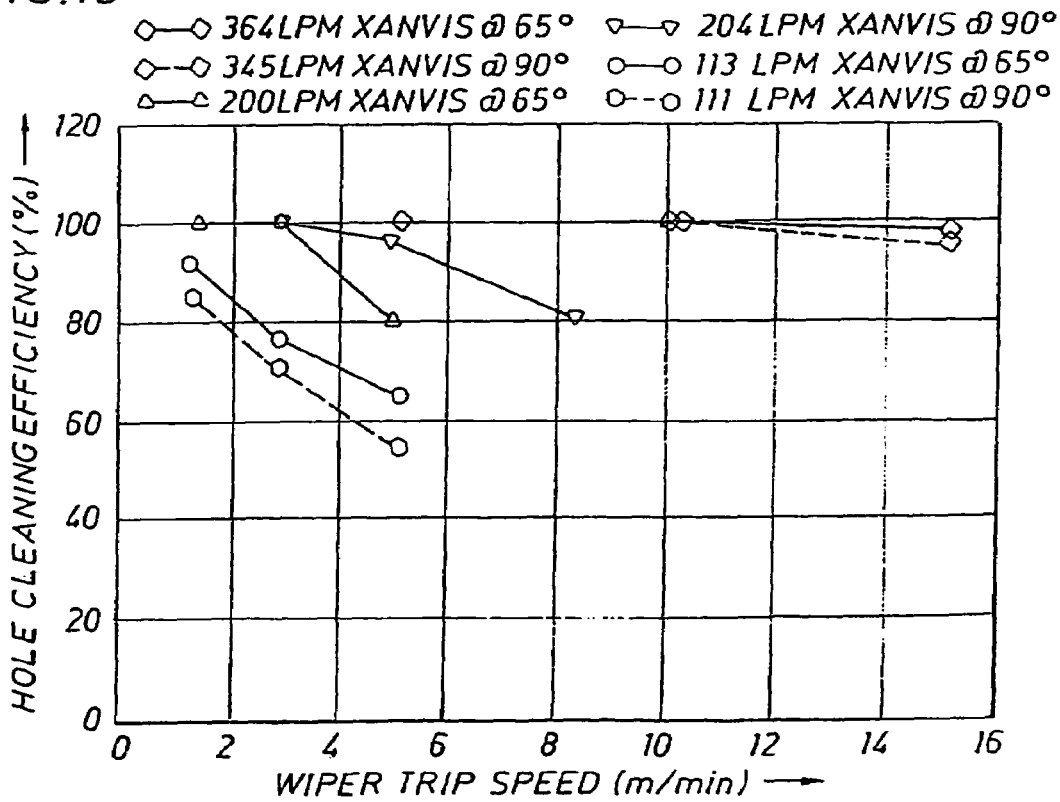
FIG. 18 illustrates the effects of deviation angle on the hole cleaning efficiency with fluids and nozzles in experiments associated with the instant invention.

Effect of deviation angle. The experimental results in the previous study (see above references) show that the highest minimum in-situ liquid velocity needed is for deviation angels of approximately 60°. The effect of deviation angle on the hole cleaning efficiency with the wiper trip mode is shown in FIG. 18. The general trend at higher flow rates typical for 1½" coiled tubing is that there is not a significant difference in solids transport effectiveness between horizontal and 65 degrees. There are distinct differences for fluid types, for example with water, solids transport proves more difficult at 65 degrees than at horizontal, but, with XANVIS gel, 65 degrees is easier, than horizontal.

Figure 19:
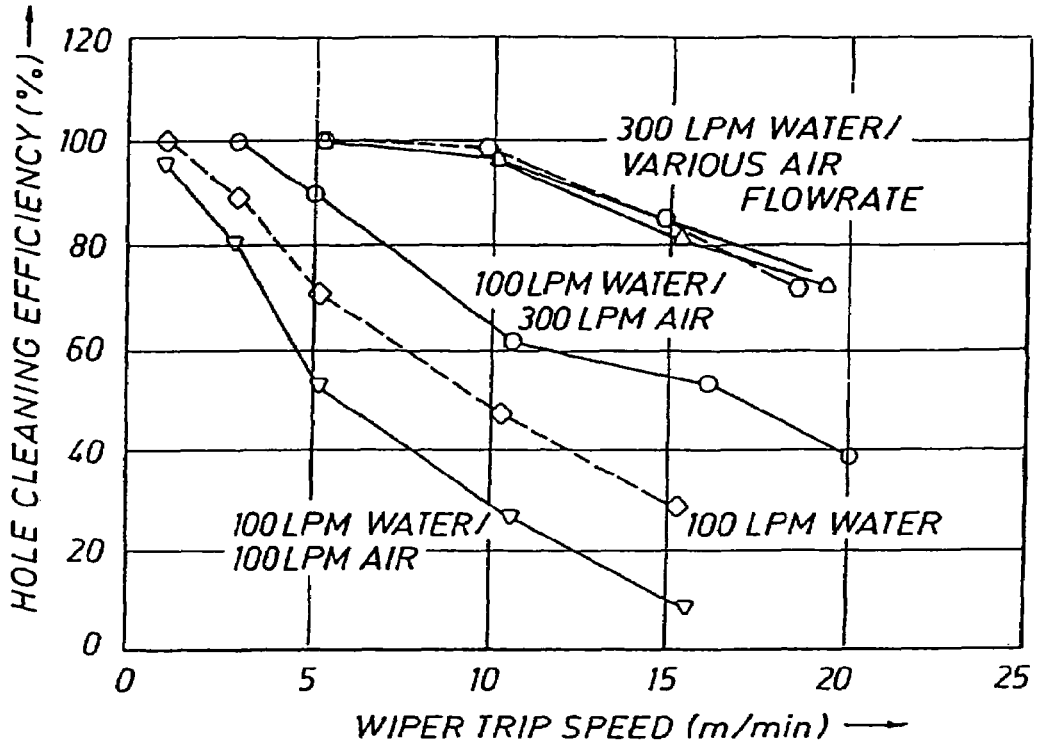
FIG. 19 illustrates the effects of gas phase on the cleaning efficiency for particulate fill in a particulate nozzle in experiments associated with the instant invention.
Figure 20:
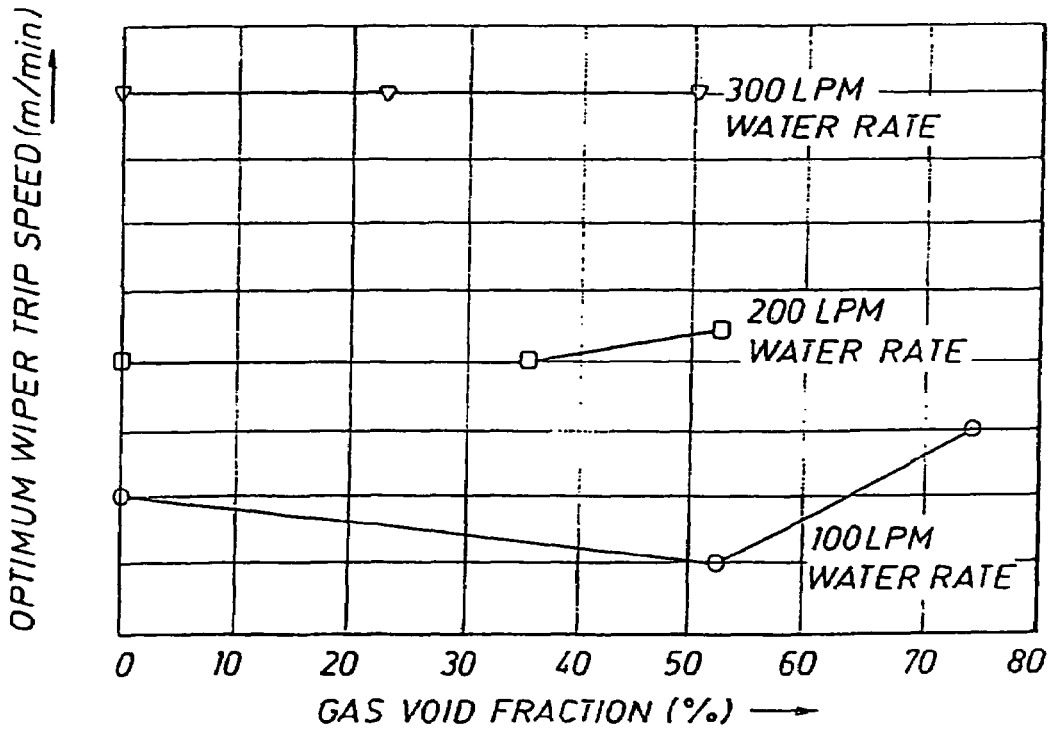
FIG. 20 illustrates the effects of gas volume fraction on wiper trip speed for particulate fill for a particulate nozzle in a deviated well in experiments associated with the instant invention.

Multi-phase flow effect. Multi-phase flow is very complex and if used incorrectly can be a disadvantage and provide poor hole cleaning, whereas if the addition of the gas phase is understood, there are advantages that prove beneficial for solids transport. FIGS. 19 and 20 display the multi-phase flow effect for various gas volume 26 fractions. With the addition of the gas phase up to a gas volume fraction (GVF) of 50% in stationary circulation, hole cleaning can be improved by up to 50%. Whereas with wiper trip hole cleaning, the addition of the gas phase up to GVF 50% only produces an improved cleanout effectiveness of 10-20%. For example, if the well was 80% cleaned out with water in the wiper trip hole cleaning mode, with the addition of the gas phase the solids transport effectiveness could be increased to 85%. Even though with stationary circulation hole cleaning there is a substantial increase in hole cleaning effectiveness with the addition of the gas phase, the use of the wiper trip method is more effective than just the addition of the gas phase. The addition of the gas phase is beneficial in low pressure reservoirs and where there are limitations due to hydrostatic conditions.

As shown in FIG. 19, there is not a significant effect on solids transport effectiveness with the addition of the gas phase at high relative in-situ liquid velocities. As the relative in-situ liquid velocity is decreased to a low value, solids transport effectiveness is dependent on the addition of the gas phase. As the gas phase is added the solids transport effectiveness decreases until more gas is added and the relative in-situ velocity starts to increase, which causes an improvement in solids transport effectiveness.

FIG. 20 displays the effect of adding gas to the system resulting in a decrease in optimum wiper trip speed. The three curves represent situations that involve the addition of gas and the reduction of the liquid flow rate, keeping the total combined flow rate constant. There is a greater dependency on the addition of gas at the higher total flow rates on the optimum wiper trip speed compared to the lower flow rates. As more gas is added with a constant total combined flow rate the optimum wiper trip speed decreases, but the solids transport effectiveness generally improves when gas is added to the system with a fixed liquid flow rate as shown in FIG. 19. The complexity of the multi-phase flow behavior makes it more difficult to generalize the test results.

Based on the experimental study and the analysis of the hole cleaning process, it was found that the use of the wiper trip produces a more effective cleanout than stationary circulation hole cleaning. It was found that for a given set of well conditions, there is an optimum wiper trip speed at which the solids can be completely removed. The optimum wiper trip speed is dependent on the deviation angle, fluid type, particle size, and nozzle type. Nozzles with correctly selected jet arrangements yield an effective cleanout operation.

The investigation of particle size included a wide range and the results suggest that when the borehole is at various inclined angles for particles from 0.15 mm up to 7 mm in diameter, there is a significant effect on solids transport. Spherical particles such as frac sands are the easiest to cleanout and wellbore fines prove more difficult, but the larger particles such as drilled cuttings pose the greatest difficulty for solids transport.

Fluid rheology plays an important role for solids transport, and to achieve optimum results for hole cleaning, the best way to pick up solids is with a low viscosity fluid in turbulent flow, but to maximize the carrying capacity, a gel or a multiphase system should be used to transport the solids out of the wellbore.

The large number of independent variables influencing solids transport demands that a computer model be used to make predictions effectively.

The foregoing description of preferred embodiments of the invention is presented for purposes of illustration and description, and is not intended to be exhaustive or to limit the invention to the precise form or embodiment disclosed. The description was selected to best explain the principles of the invention and their practical application to enable others skilled in the art to best utilize the invention in various embodiments. Various modifications as are best suited to the particular use are contemplated. It is intended that the scope of the invention is not to be limited by the specification, but to be defined by the claims set forth below.

What is claimed is:

1. A method of cleaning fill from a wellbore comprising: creating a localized slurry of particulate solids while circulating a cleanout fluid in a coiled tubing in the wellbore; and determining a POOH speed for the coiled tubing in the wellbore whereby the particulate solids in the wellbore are maintained uphole of an end of the coiled tubing while circulating the cleanout fluid at a flow rate that is less than a critical deposition velocity such that the particulate solids are substantially removed from the wellbore.

2. The method of claim 1 wherein the POOH speed is determined by computer modeling.

3. The method of claim 2 wherein the computer modeling further determines the POOH speed for a given type of fluid and for a particle size of the solids.

4. The method of claim 2 wherein the computer modeling further determines the POOH speed in light of a type of selected cleanout fluid.

5. The method of claim 4 in which the computer modeling further determines the POOH speed in light of an in-situ velocity of the cleanout fluid.

6. The method of claim 2 wherein the computer modeling further determines a RIH speed such that the run-in speed combined with a selection of a cleanout fluid, a pump rate, and power jetting disturbs and redistributes the particulate solids to create an equilibrium bed.

7. The method of claim 6 wherein the wellbore is a deviated wellbore.

8. The method of claim 6 wherein the particulate solids at a leading edge of an equilibrium bed are transported to the surface.

9. The method of claim 2 wherein the fluid is a biopolymer.

10. The method of claim 2 wherein the computer modeling further determines the POOH speed in light of at least one of bottom hole pressure (BHP), surface pressure, or two-phase flow.

11. The method of claim 2 wherein the computer modeling further determines the POOH speed in light of a type of nozzle configuration through which the cleanout fluid is circulated.

12. The method of claim 2 wherein the computer modeling further determines the POOH speed in light of a deviation angle of the wellbore.

* * * * *

UNITED STATES PATENT AND TRADEMARK OFFICE

CERTIFICATE OF CORRECTION

PATENT NO. : 7,377,283 B2
APPLICATION NO. : 11/283916
DATED : May 27, 2008
INVENTOR(S) : Scott A. Walker et al.

It is certified that error appears in the above-identified patent and that said Letters Patent is hereby corrected as shown below:

Column 17, Line 24: after FIG., delete "16" and insert --17--

Signed and Sealed this

Twenty-ninth Day of July, 2008

JON W. DUDAS
*Director of the United States Patent and Trademark Office*